US005926193A

United States Patent [19]

Umeda

[11] Patent Number: 5,926,193

[45] Date of Patent: Jul. 20, 1999

[54] PRINTER HAVING POWER TRANSMISSION CHANGE-OVER MECHANISM FOR PURGING MECHANISM

[75] Inventor: Takaichiro Umeda, Nagoya, Japan

[73] Assignee: Brother Kogyo Kabushiki Kaisha, Nagoya, Japan

[21] Appl. No.: 08/746,871

[22] Filed: Nov. 15, 1996

[30] Foreign Application Priority Data

Nov. 20, 1995 [JP] Japan ..... 7-326601
Nov. 20, 1995 [JP] Japan ..... 7-326602

[51] Int. Cl.[6] ..... B41J 2/165

[52] U.S. Cl. ..... 347/30; 347/23

[58] Field of Search ..... 342/30, 29, 38, 342/32; 374/104, 29, 30, 31, 32, 35; 347/30, 29, 38, 32, 104, 37, 23

[56] References Cited

U.S. PATENT DOCUMENTS 5,126,764 6/1992 Miyauchi et al. ..... 347/30
5,148,203 9/1992 Hirano ..... 347/30

FOREIGN PATENT DOCUMENTS 000626265 11/1994 European Pat. Off. ..... 347/7
2 161 117 1/1986 United Kingdom ..... 347/29
2 279 041 12/1994 United Kingdom ..... 347/30

*Primary Examiner*—N. Le
*Assistant Examiner*—Thien Tran
*Attorney, Agent, or Firm*—Oliff & Berridge, PLC

[57] ABSTRACT

A printer having a change-over mechanism for selectively transmitting driving power of a line feed motor to a purge mechanism. A power distribution gear driven by the line feed motor is selectively engageable with a purge gear which drives a negative pressure generating unit of the purge mechanism. A first reclinable portion is pivotally positioned at a boundary between a printing region and a capping region, and a second reclinable portion is pivotally positioned in the printing region. The first and second reclinable portions are connected together by a link so as to upstand one of the first and second reclinable portions in response to reclining movement of the other. The first reclinable portion has an idle kicker depressable against the power distribution gear for disengaging the latter from the purge gear. A carriage mounting thereon print heads has a rib which is abuttable against the first and second reclinable portions to obtain their reclining positions. When the rib kicks down the first reclinable portion, the idle kicker moves away from the power distribution gear, so that the latter is brought into engagement with the purge gear. When the rib kicks down the second reclinable portion, the first reclinable portion rotates to its upstanding position, so that the idle kicker depresses the power distribution gear.

31 Claims, 24 Drawing Sheets

FIG. 10(a)
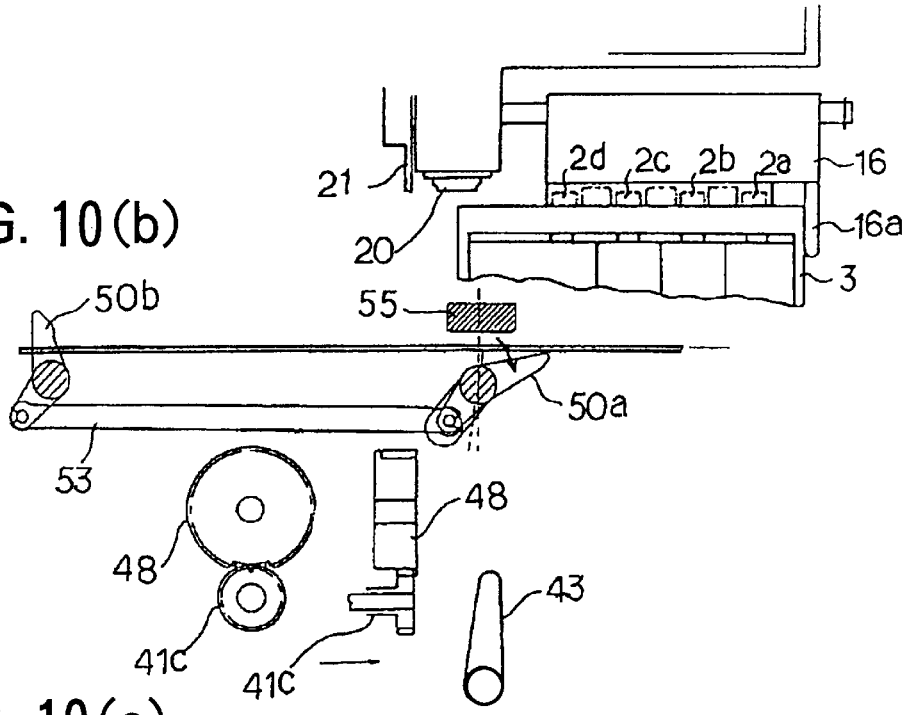
FIG. 10(b)
FIG. 10(c)
FIG. 10(d)
FIG. 11(a)
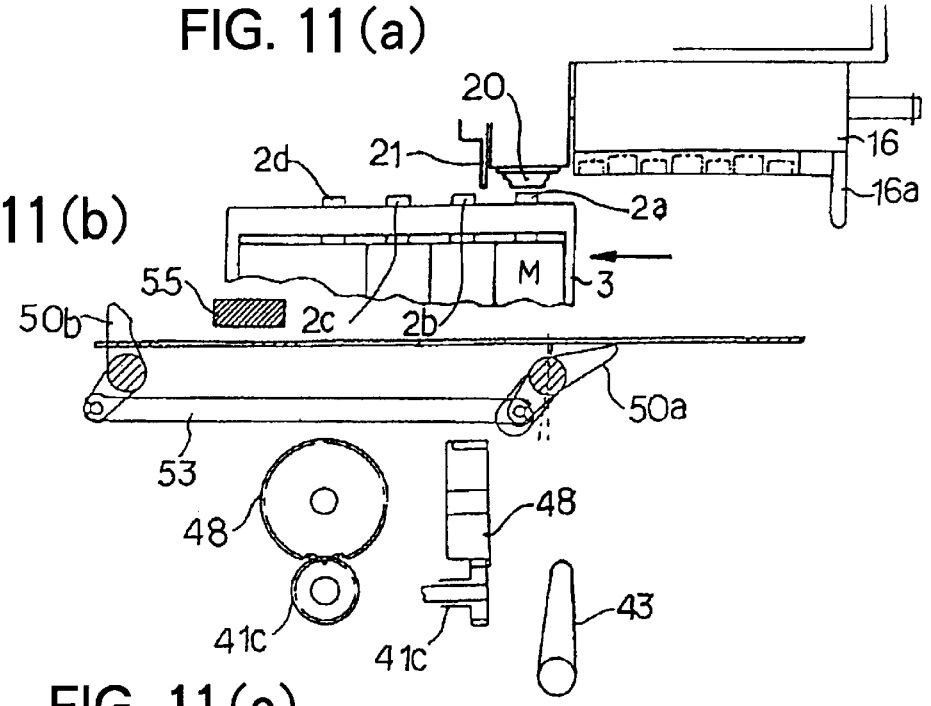
FIG. 11(b)
FIG. 11(c)
FIG. 11(d)

FIG. 12(a-1)
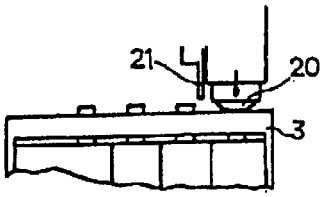
FIG. 12(a-2)
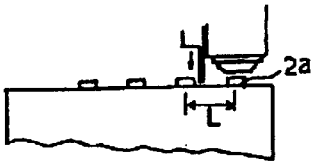
FIG. 12(a-3)
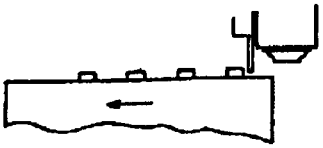
FIG. 12(a-4)
FIG. 12(b)
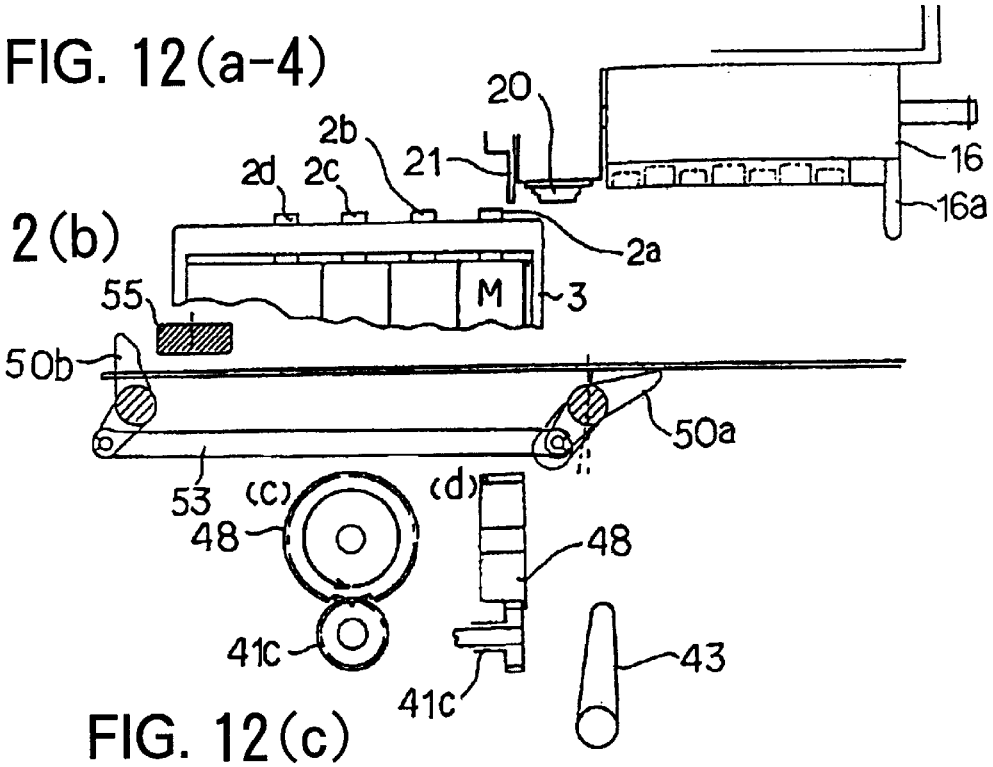
FIG. 12(c)
FIG. 12(d)

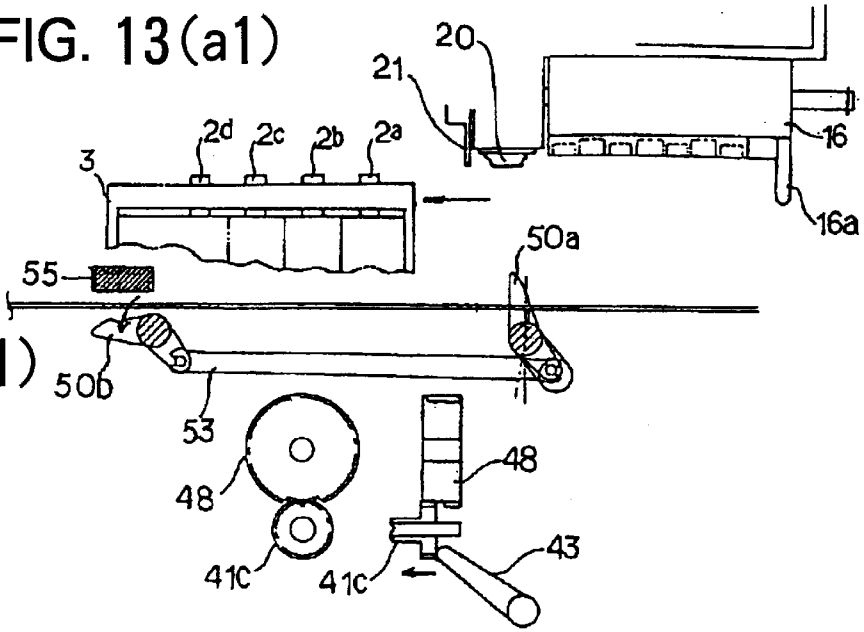
FIG. 13(a1)
FIG. 13(b1)
FIG. 13(c)
FIG. 13(d)
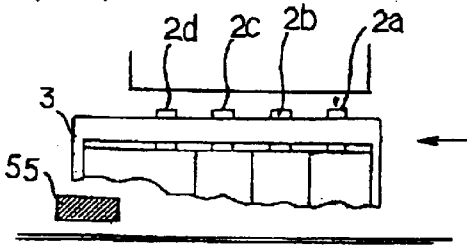
FIG. 13(a2)
FIG. 13(b2)

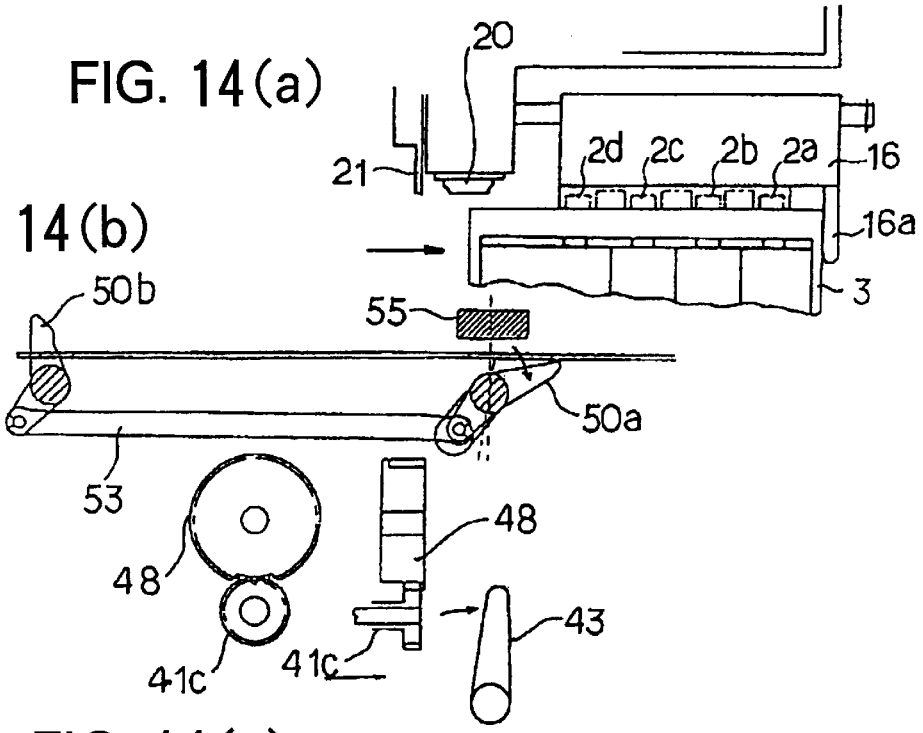
FIG. 14(a)
FIG. 14(b)
FIG. 14(c)
FIG. 14(d)
20
21
2d
2c
2b
2a
16
16a
3
55
50b
50a
53
48
48
43
41c
41c
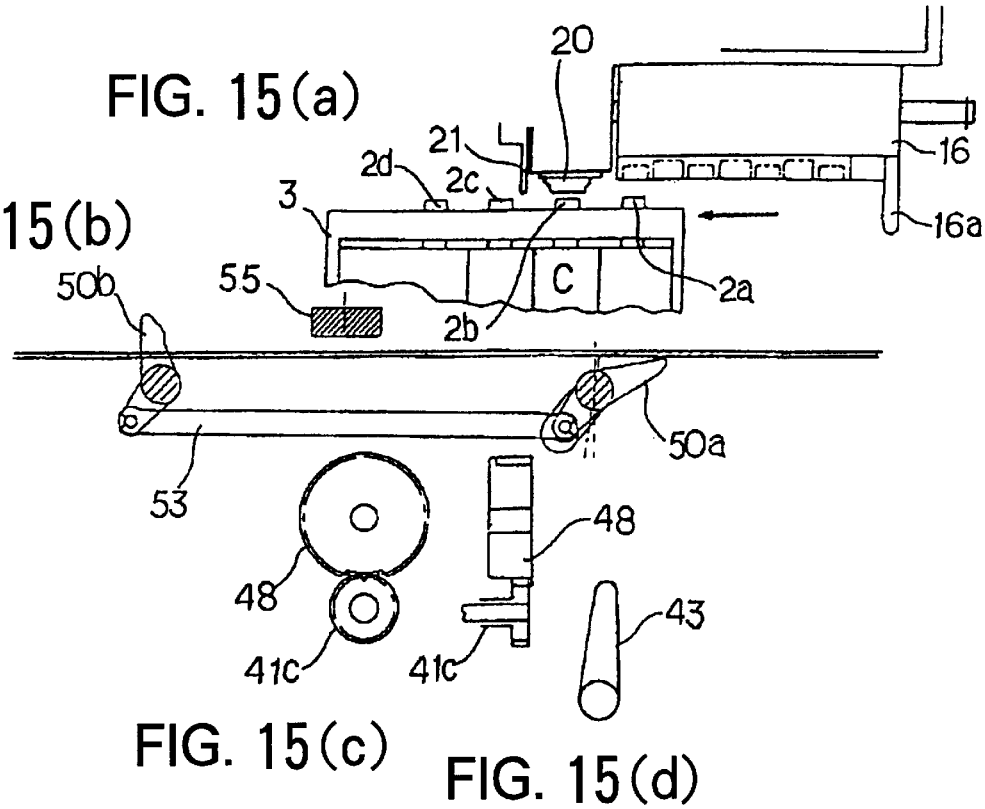
FIG. 15(a)
FIG. 15(b)
FIG. 15(c)
FIG. 15(d)
20
21
2d
2c
3
16
16a
C
2a
2b
55
50b
50a
53
48
48
43
41c
41c

P
21
20
16

2d
2c
2b
2a
3
50b
55
53
50a
PRINTING REGION
CAPPING REGION
a
START-UP
v
48
48
41c
41
43

FIG. 20(a)
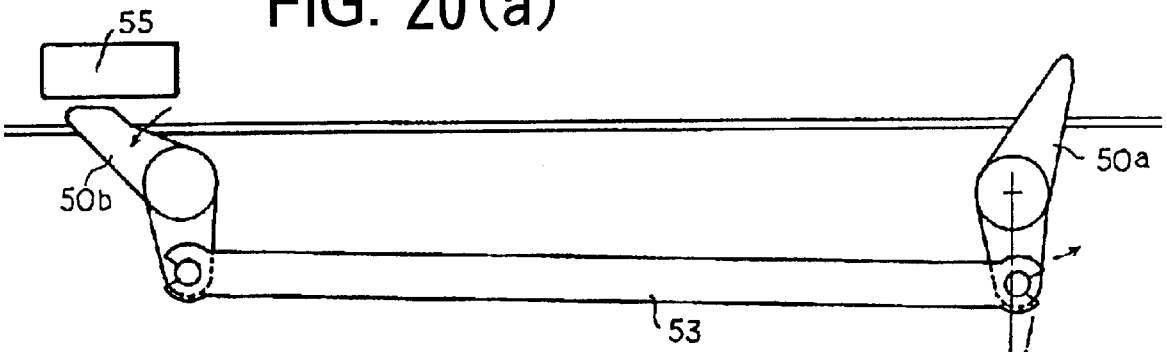
FIG. 20(b)
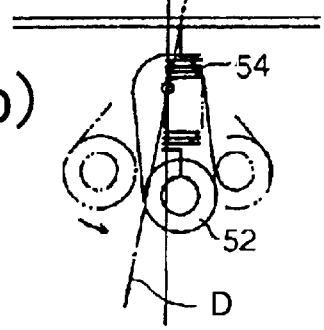
FIG. 20(c)
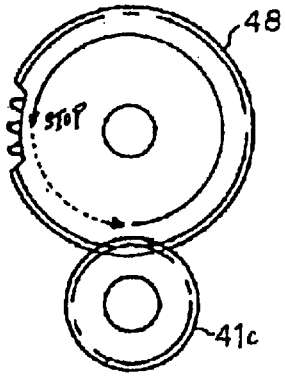
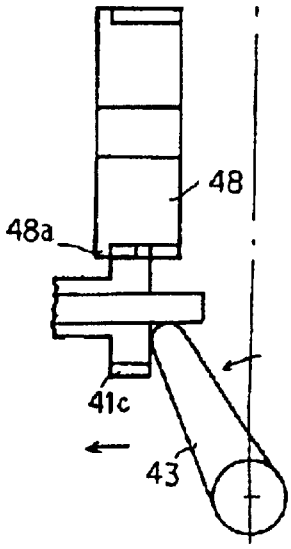
FIG. 20(d)

FIG. 23(a)
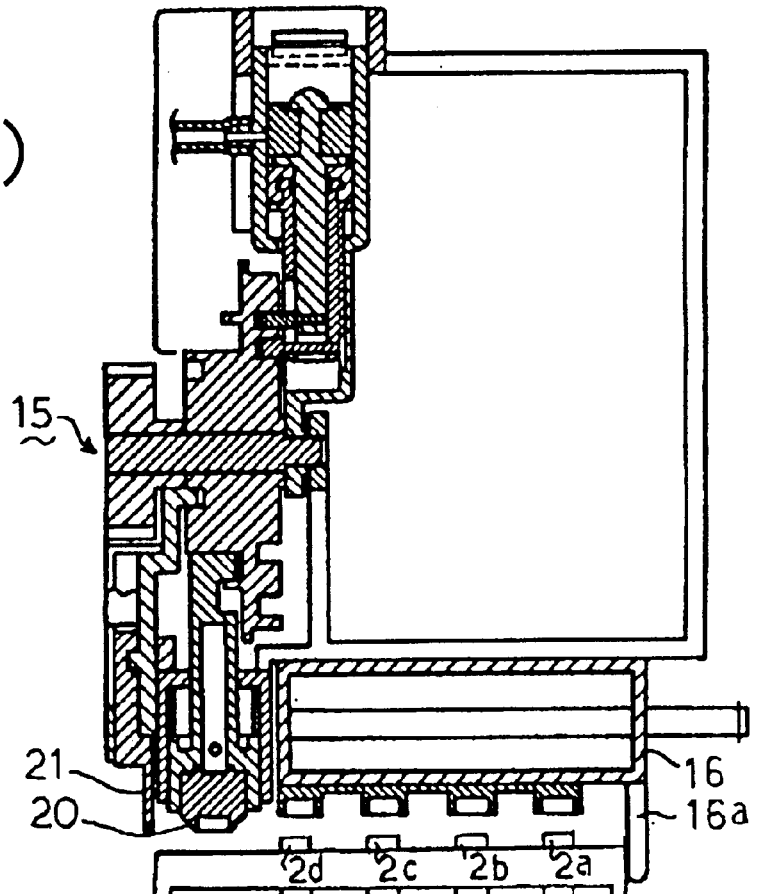
FIG. 23(b)
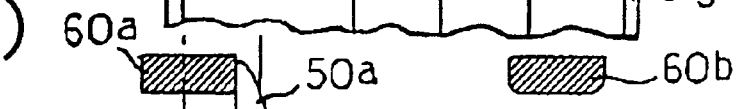
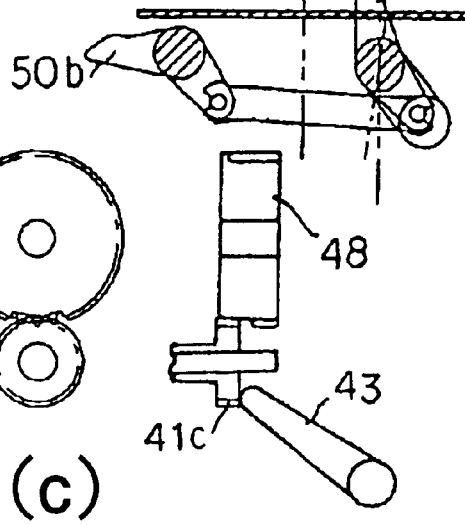
FIG. 23(c)
FIG. 23(d)

21
20
3

60a
60b
50b
50a 48
48
43
41c
41c 21
20
16
16a
2d
2c
2b
2a
3
60a
60b
50a 50b
53
48
48
41c
43
41c

X

PRINTER HAVING POWER TRANSMISSION CHANGE-OVER MECHANISM FOR PURGING MECHANISM

BACKGROUND OF THE INVENTION

The present invention relates to a printer having a power transmission change-over or switching mechanism, and more particularly, to the change-over mechanism for selectively transmitting driving power from a power source to a purging mechanism at a proper timing.

In an image recording apparatus such as an ink jet printer and a facsimile machine, ink ejection type image formation is known in which ink droplet is ejected from a nozzle of a print head onto an image recording medium such as a paper sheet to form an inked image. In such a type of the image recording apparatus, bubbles may be generated in the print head, or ink may be adhered onto the surface of the nozzle of the print head, which cause insufficient ink ejection. In order to avoid this drawback and to recover sufficient ink ejecting fashion, a maintenance device such as a purging mechanism is provided in the apparatus.

According to the purging mechanism a suction cap is mounted on the print head, and negative pressure is generated by a pump so as to suck interior ink and bubbles in the print head. As a drive source for driving the pump and other components in the purging mechanism, a line feed motor is commonly used which serves as a drive source for feeding the printing sheet in a sheet feeding direction, that is for driving a platen. With this arrangement, parts and components can be reduced, and production cost can be lowered.

In such an image recording apparatus in which the drive source is commonly used for driving the purging mechanism as well as the sheet feeding mechanism, a power transmission change-over mechanism is provided so as to selectively transmit the driving power from the power source to the purging mechanism. More specifically, there are provided a power transmission gear to which driving power from the drive source is transmitted, a drive gear or negative pressure gear for driving the purging mechanism, and a drive gear or feed gear for driving the sheet feeding mechanism. The power transmission gear is selectively engageable with the negative pressure gear or the feed gear, so that at least one of or both the negative pressure gear and the feed gear are rotatable. The power transmission gear is moved to a position to meshingly engage the negative pressure gear so as to drive the purging mechanism, when a carriage mounting thereon the print head is moved to a capping position where the print head is covered with a protection cap provided in the image recording apparatus.

However, in the above described conventional power transmission change-over mechanism, if the carriage is moved to another position from the capping position, the power transmission gear is disengaged from the negative pressure gear even if the purging mechanism is still operated. Therefore, if the electrical power supply is shut off while the nozzle recovery operation is performed when the carriage is positioned at the capping position, and if an operator manually moves the carriage to a position other than the capping position during turning OFF state of the electrical power, the power transmission gear is disengaged from the negative pressure gear even if the nozzle recovery operation has not been completed. Consequently, it would be difficult to restore the previous position, i.e., it would be difficult to again engage the power transmission gear with the negative pressure gear. This may cause breakdown or damage of the image recording apparatus.

Further, if the above described conventional changeover mechanism is provided in a color printer in which a plurality of print heads are provided for ejecting inks of different colors, and if a single purging mechanism is provided for successively performing nozzle recovery operation with respect to each print head, the carriage must be successively moved so that each one of the print heads is moved to a position in confrontation with the single purging mechanism. Due to this movement of the carriage, the power transmission gear may be disengaged from the negative pressure gear. Accordingly, it would be difficult to smoothly and equally perform nozzle recovery operation for the all nozzles of the print heads.

SUMMARY OF THE INVENTION

It is therefore, an object of the present invention to overcome the above described drawbacks and deficiencies, and to provide an improved image recording apparatus having a power transmission change over mechanism capable of maintaining power transmission from the power source to the purging mechanism in a predetermined moving region of the carriage. That is, the power transmission change-over mechanism according to the present invention is capable of maintaining meshing engagement between the power transmission gear and the negative pressure gear during the maintenance regardless of the movement and position of the carriage in a predetermined moving region thereof after the power transmission gear is engaged with the negative pressure gear.

This and other objects of the present invention will be attained by a printer for printing an image on a printing paper in a printing region, the printer including a sheet feed mechanism for feeding the printing paper in a sheet feeding direction, a printing portion including a carriage movable in a line extending direction, and at least one print head at which a nozzle is formed for ejecting an ink, the print head being mounted on the carriage, a purging mechanism including a negative pressure generating portion and a suction cap in communication therewith for covering the nozzle, a drive source for driving the sheet feed mechanism and the negative pressure generating portion; and an improved change-over mechanism for selectively transmitting a driving power of the drive source to the negative pressure generating portion. The change over mechanism includes a power transmission member, a power transmission change over unit, an abutting piece, and means for moving the power transmission member. The power transmission member is driven by the drive source and is movable between a power shut off position and a power transmission position. The power transmission change-over unit includes first and second reclinable portions. The first reclinable portion is movable between an upstanding position and a reclining position for moving the power transmission member from the power shut off position to the power transmission position. The second reclinable portion is movable between an upstanding position and a reclining position for moving the power transmission member from the power transmission position to the power shut-off position. The second reclinable portion is positioned closer to the printing region than is the first reclinable portion. One of the first and second reclinable portions is movable to its upstanding position when remaining one of the second and first reclinable portion is moved to its reclining position. The abutting piece is provided to the carriage. The abutting piece is abuttable against the first or second reclinable portion for reclining the first or second reclinable portion when the first or second reclinable portion has its upstanding position. The moving means is adapted for moving the power transmission member from the power shut off position to the power transmission position in response to the reclining movement of the first reclinable portion and for moving the power transmission member from the power transmission position to the power shut off position in response to the reclining movement of the second reclinable portion.

In another aspect of the present invention, there is provided a printer including the above described sheet feed mechanism, the printing portion, the purging mechanism, the drive source, and an improved change-over mechanism. The change over mechanism includes a power transmission gear, a negative pressure gear, means for pressing the power transmission gear, and an abutting piece. The power transmission gear is driven by the drive source and is movable in an axial direction thereof between a power shut off position and a power transmission position. The negative pressure gear is adapted for transmitting the driving power from the power transmission gear to the negative pressure generating portion. The negative pressure gear is engaged with the power transmission gear in the power transmission position and the negative pressure gear is disengaged from the power transmission gear in the power shut-off position. The pressing means includes a shaft portion, a kicker portion, a first reclinable portion, and a second reclinable portion. The kicker portion is pivotally movable about an axis of the shaft portion for moving the power transmission gear in the axial direction of the power transmission gear. The first reclinable portion is movable between an upstanding position and a reclining position for moving the power transmission gear from the power shut off position to the power transmission position. The first reclinable portion is pivotable about the axis of the shaft portion. The second reclinable portion is movable between an upstanding position and a reclining position for moving the power transmission gear from the power transmission position to the power shut-off position. The second reclinable portion is positioned in the printing region. One of the first and second reclinable portions is movable to its upstanding position when remaining one of the second and first reclinable portion is moved to its reclining position. The abutting piece is provided to the carriage. The abutting piece is abuttable against the first or second reclinable portion for reclining the first or second reclinable portion when the first or second reclinable portion has its upstanding position.

In still another aspect of the present invention, there is provided a printer including the above described sheet feed mechanism, the printing portion, the purging mechanism, the drive source, and an improved change-over mechanism. The change over mechanism includes a power transmission gear driven by the drive source, a negative pressure gear, a power transmission change-over unit, means for permitting relative disengagement of the power transmission gear from the negative pressure gear when the negative pressure gear is rotated at a predetermined rotating position, and an abutting piece. The negative pressure gear is engageable with the power transmission gear to provide a power transmitting state for transmitting driving power from the power transmission gear to the negative pressure generating portion. The negative pressure gear is disengageable from the power transmission gear to provide a power shut off state. The power transmission change-over unit includes first and second reclinable portions, and means for assisting positioning of the first and second reclinable portions. The first reclinable portion is movable between an upstanding position and a reclining position for providing engagement between the power transmission gear and the negative pressure gear. The second reclinable portion is movable between an upstanding position and a reclining position for providing relative disengagement of the power transmission gear from the negative pressure gear. The second reclinable portion is positioned closer to the printing region than is the first reclinable portion. One of the first and second reclinable portions is movable to its upstanding position when remaining one of the second and first reclinable portion is moved to its reclining position. The abutting piece is provided to the carriage and is abuttable against the first or second reclinable portion for reclining the first or second reclinable portion when the first or second reclinable portion has its upstanding position. One of the power transmission gear and the negative pressure gear is slidingly movable in one direction to engage the remaining one of the negative pressure gear and the power transmission gear when the abutting piece kicks down the first reclinable portion in accordance with the movement of the carriage toward a direction outside the printing region. One of the power transmission gear and the negative pressure gear being slidingly movable in opposite direction to disengage from the remaining one of the negative pressure gear and the power transmission gear when the abutting piece kicks down the second reclinable portion in accordance with the movement of the carriage toward the printing region as far as the negative pressure gear has the given rotational position. Further, one of the power transmission gear and the negative pressure gear is slidingly movable in the opposite direction while engagement between the power transmission gear and the negative pressure gear is maintained if the negative pressure gear is at a rotational position other than the given rotational position.

BRIEF DESCRIPTION OF THE DRAWINGS

In the drawings;

FIG. 4(*b*) is a view for description of a tension spring according to the first embodiment before the carriage enters the capping region;

FIG. 5(*b*) is a view for description of the tension spring according to the first embodiment after the carriage goes out of the capping region and further moves toward the printing region;

FIG. 6(*b*) is opposite side view showing the purge gear;

FIG. 6(*c*) is a partial perspective view showing the purge gear;

FIG. 7(*b*) is a cross-sectional view showing the meshing relation among the platen gear or the feed gear, the pump cam gear, the power distribution gear, the motor gear and the purge gear, and showing a state where the purge gear is disengaged from the power distribution gear;

FIG. 9(*b*) is a view for description of a geometrical relationship among the rib, the first reclinable portion and the second reclinable portion according to the first embodiment when the carriage is about to go into the capping region;

FIG. 9(*c*) is a view for description of the meshing relation between the purge gear and the power distribution gear in the state shown in FIGS. 9(*a*) and 9(*b*);

FIG. 9(*d*) is a view for description of the axial position of the power distribution gear and orientation of an idle kicker in the state shown in FIGS. 9(*a*) and 9(*b*);

FIG. 10(*a*) is a view showing a movement of a cap of the purge mechanism when the carriage is moved into the capping region;

FIG. 10(*b*) is a view for description of a geometrical relationship among the rib, the first reclinable portion and the second reclinable portion according to the first embodiment when the carriage moves into the capping region;

FIG. 10(*c*) is a view for description of the meshing relation between the purge gear and the power distribution gear in the state shown in FIGS. 10(*a*) and 10(*b*);

FIG. 10(*d*) is a view for description of the axial position of the power distribution gear and orientation of the idle kicker in the state shown in FIGS. 10(*a*) and 10(*b*);

FIG. 11(*a*) is a view showing the geometrical relation between the carriage and the purge mechanism when the carriage moves toward the printing region;

FIG. 11(*b*) is a view for description of a geometrical relationship among the rib, the first reclinable portion and the second reclinable portion according to the first embodiment when the carriage moves toward the printing region;

FIG. 11(*c*) is a view for description of the meshing relation between the purge gear and the power distribution gear in the state shown in FIGS. 11(*a*) and 11(*b*);

FIG. 11(*d*) is a view for description of the axial position of the power distribution gear and orientation of the idle kicker in the state shown in FIGS. 11(*a*) and 11(*b*);

FIGS. 12(*a*-1) through 12(*a*-4) are views for description of the positional relation between the carriage and a suction cap and a wiper blade of the purge mechanism;

FIG. 12(*b*) is a view for description of a geometrical relationship among the rib, the first reclinable portion and the second reclinable portion according to the first embodiment when the carriage further moves toward the printing region;

FIG. 12(*c*) is a view for description of the meshing relation between the purge gear and the power distribution gear in the state shown in FIG. 12(*a*-4) and 12(*b*);

FIG. 12(*d*) is a view for description of the axial position of the power distribution gear and orientation of the idle kicker in the state shown in FIGS. 12(*a*-4) and 12(*b*);

FIG. 13(*a*1) is a view showing a state where the carriage is further moved toward the printing region;

FIG. 13(*a*2) is a view showing a state where the carriage reaches a flashing region;

FIG. 13(*b*1) is a view for description of a geometrical relationship among the rib, the first reclinable portion and the second reclinable portion according to the first embodiment when the carriage further moves toward the printing region;

FIG. 13(*b*2) is a view for description of a positional relation between the rib and the second reclinable portion in a state shown in FIG. 13(*a*21);

FIG. 13(*c*) is a view for description of the meshing relation between the purge gear and the power distribution gear in the state shown in FIG. 13(*a*1) and 13(*b*1);

FIG. 13(*d*) is a view for description of the axial position of the power distribution gear and orientation of the idle kicker in the state shown in FIGS. 13(*a*1) and 13(*b*1);

FIG. 14(*a*) is a view showing the geometrical relation between the carriage and the purge mechanism when the carriage moves from the flashing region to the capping region;

FIG. 14(*b*) is a view for description of a geometrical relationship among the rib, the first reclinable portion and the second reclinable portion according to the first embodiment in the state shown in FIG. 14(*a*);

FIG. 14(*c*) is a view for description of the meshing relation between the purge gear and the power distribution gear in the state shown in FIGS. 14(*a*) and 14(*b*);

FIG. 14(*d*) is a view for description of the axial position of the power distribution gear and orientation of the idle kicker in the state shown in FIGS. 14(*a*) and 14(*b*);

FIGS. 15(*a*) through 15(*d*) are views substantially the same as those shown in FIGS. 11(*a*) through 11(*d*), but a second print head for cyan color is subjected to purging operation;

FIG. 19(*b*) is a view for description of a geometrical relationship among the rib, the first reclinable portion and the second reclinable portion according to the first embodiment in a state shown in FIG. 19(*a*);

FIG. 19(*c*) is a view for description of the meshing relation between the purge gear and the power distribution gear in the state shown in FIGS. 19(*a*) and 19(*b*);

FIG. 19(*d*) is a view for description of the axial position of the power distribution gear and orientation of the idle kicker in the state shown in FIGS. 19(*a*) and 19(*b*);

FIG. 20(*a*) is a view for description of a geometrical relationship among the rib, the first reclinable portion and the second reclinable portion according to the first embodiment in a state where the carriage is inadvertently moved manually toward the printing region after the electrical power supply is shut off during purging operation;

FIG. 20(*b*) is a view for description of the tension spring in the state shown in FIG. 20(*a*);

FIG. 20(*c*) is a view for description of the meshing relation between the purge gear and the power distribution gear in the state shown in FIGS. 20(*a*) and 20(*b*);

FIG. 20(*d*) is a view for description of the axial position of the power distribution gear and orientation of the idle kicker in the state shown in FIGS. 20(*a*) and 20(*b*);

FIG. 23(*a*) is a cross-sectional view showing an internal arrangement of the purge mechanism and position of the carriage according to the second embodiment;

FIG. 23(*b*) is a view for description of a geometrical relationship among a first and second ribs, the first reclinable portion, and the second reclinable portion according to the second embodiment when the carriage is about to go into the capping region;

FIG. 23(*c*) is a view for description of the meshing relation between the purge gear and the power distribution gear in the state shown in FIGS. 23(*a*) and 23(*b*);

FIG. 23(*d*) is a view for description of the axial position of the power distribution gear and orientation of an idle kicker in the state shown in FIGS. 23(*a*) and 23(*b*);

FIG. 24(*b*) is a view for description of a geometrical relationship among the first and second ribs, the first reclinable portion, and the second reclinable portion according to the second embodiment in the state shown in FIG. 24(*a*);

FIG. 24(*c*) is a view for description of the meshing relation between the purge gear and the power distribution gear in the state shown in FIGS. 24(*a*) and 24(*b*);

FIG. 24(*d*) is a view for description of the axial position of the power distribution gear and orientation of an idle kicker in the state shown in FIGS. 24(*a*) and 24(*b*);

FIG. 25(*b*) is a view for description of a geometrical relationship among the first and second ribs, the first reclinable portion, and the second reclinable portion according to the second embodiment in the state shown in FIG. 25(*a*);

FIG. 25(*c*) is a view for description of the meshing relation between the purge gear and the power distribution gear in the state shown in FIGS. 25(*a*) and 25(*b*);

FIG. 25(*d*) is a view for description of the axial position of the power distribution gear and orientation of an idle kicker in the state shown in FIGS. 25(*a*) and 25(*b*);

FIG. 26(*b*) is a cross-sectional view showing engaging state of the power distribution gear with the purge gear according to the third embodiment;

FIG. 26(*c*) is a schematic perspective view showing the power distribution gear and the purge gear according to the third embodiment;

FIG. 27(*b*) is a cross-sectional view showing engaging state of the power distribution gear with the purge gear according to the fourth embodiment; and FIG. 27(*c*) is a schematic perspective view showing the power distribution gear and the purge gear according to the fourth embodiment; and FIG. 28 is a graph showing the biasing force of the tension spring and the biasing force of the compression spring according to an embodiment of the invention.

DETAILED DESCRIPTION OF THE PREFERRED EMBODIMENTS

Figure 1:
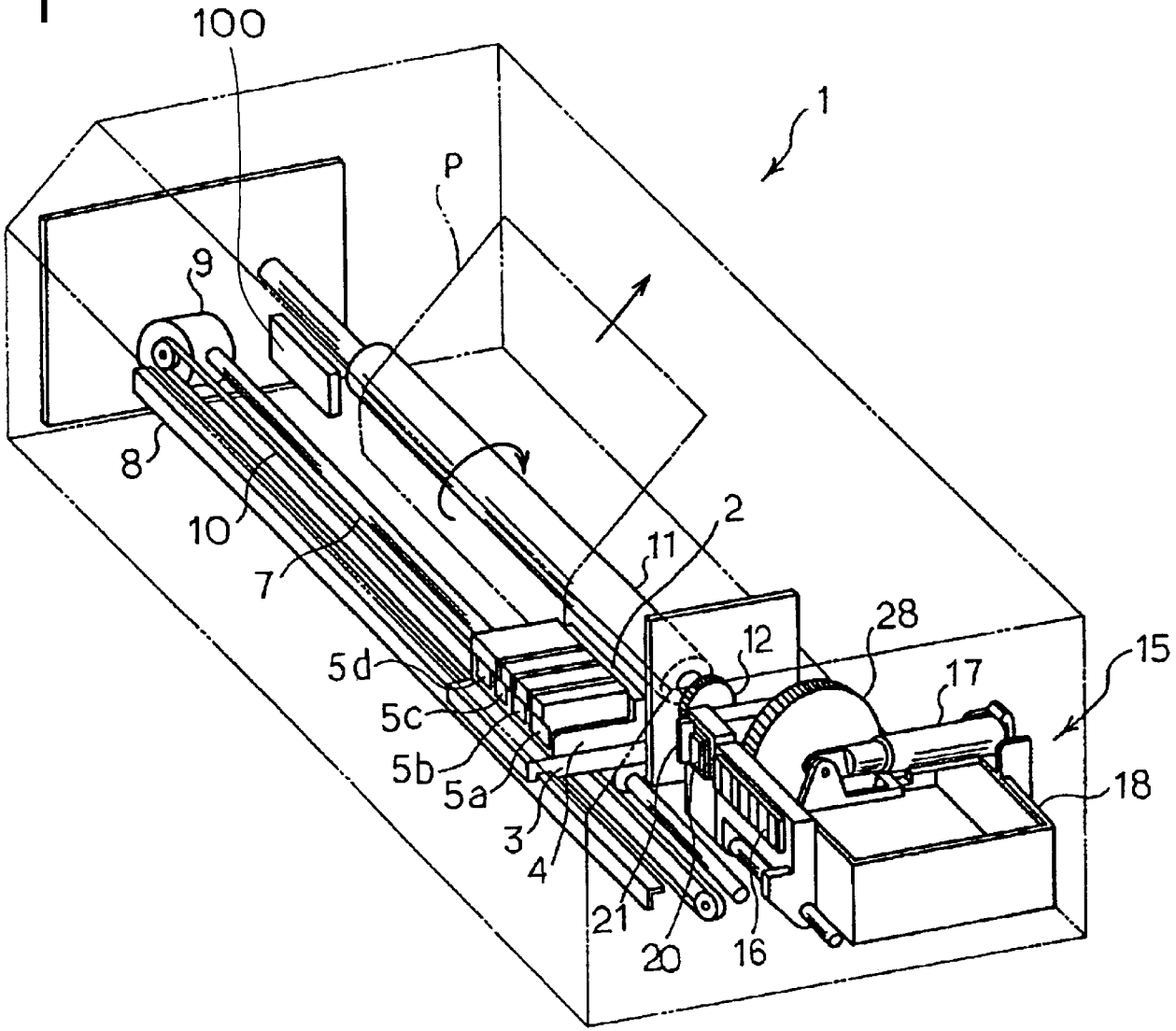
FIG. 1 is a perspective view showing a color ink jet printer provided with a power transmission change-over mechanism according to a first embodiment of the present invention.

A power transmission change-over mechanism according to a first embodiment of the present invention will be described with reference to FIGS. 1 through 20. The change-over mechanism is incorporated in a color ink jet printer shown in FIG. 1.

The printer 1 includes an ink jet type print head 2 through which inks of different colors of cyan, magenta, yellow and black are ejected onto an image recording medium or printing sheet P. The print head 2 has four nozzles for ejecting four kinds of inks therethrough. A carriage 3 is provided which is reciprocally movable linearly during printing. The print head 2 is mounted on the carriage 3. The print head 2 is integrally provided with a head unit 4, and ink cartridges 5*a*, 5*b*, 5*c*, 5*d* are detachably mounted on the carriage 3 so as to supply the different kind of inks to the print head 2. A carriage support shaft 7 extends in a reciprocating direction of the carriage 3. The carriage 3 has a bottom portion supported by the carriage support shaft 7 so that the carriage 3 can be movable along the carriage support shaft 7. A guide plate 8 extends in parallel with the carriage support shaft 7 so that the bottom portion of the carriage 3 is slidably supported on the guide plate 8. Nearby the one end of the carriage support shaft 7, a carriage motor 9 is disposed. A direct current motor is available as the carriage motor 9. An end less belt 10 is connected to the carriage 3 and is drivingly connected to the carriage motor 9, so that the carriage 3 is movable reciprocally upon reciprocating rotation of the carriage motor 9.

Figure 2:
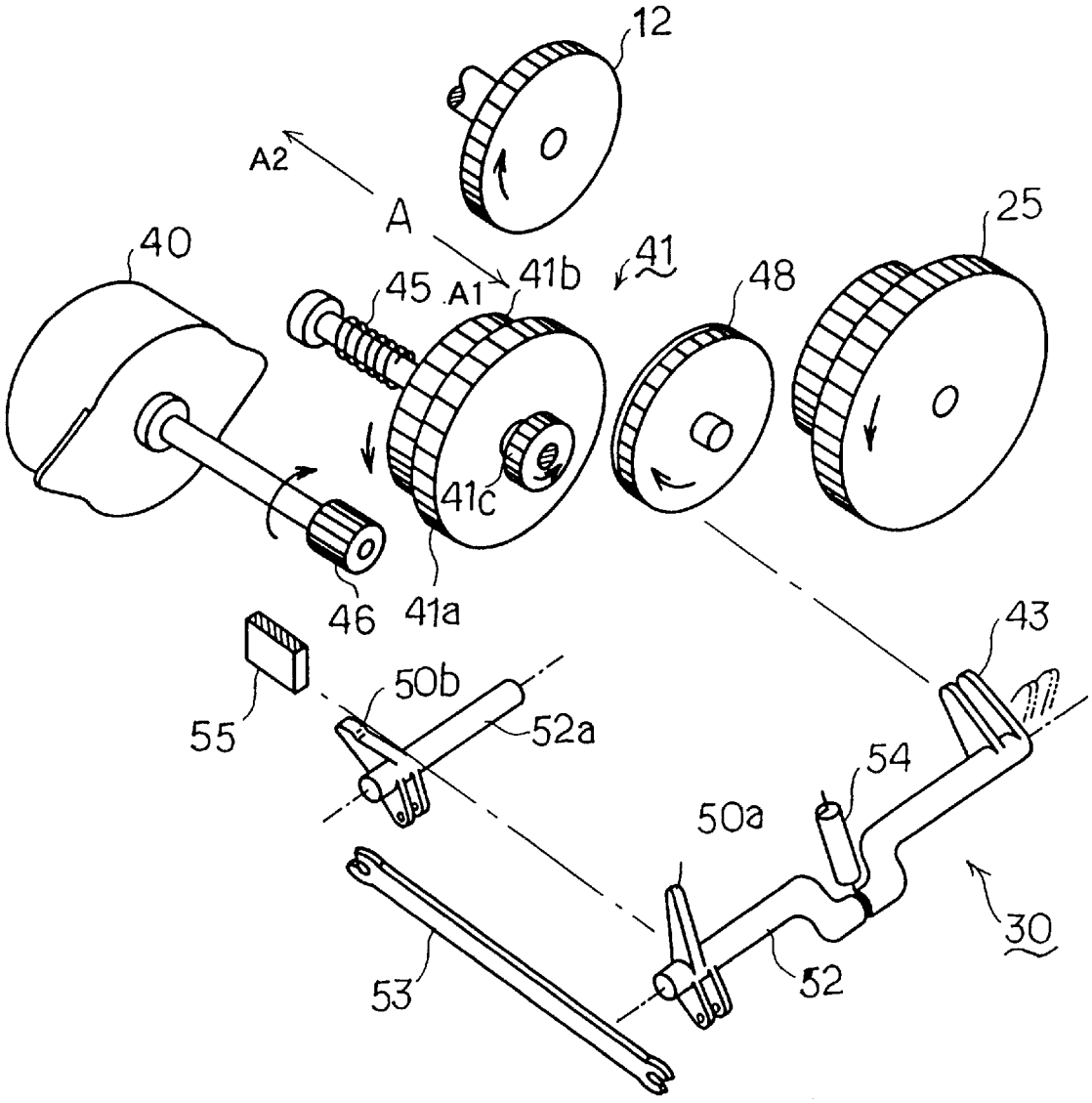
FIG. 2 is an exploded perspective view showing components of the change-over mechanism according to the first embodiment.

A platen roller 11 is rotatably provided at a position in confrontation with the print head 2. As shown in FIG. 2, a line feed motor 40 and a platen gear 12 are provided. A pulse motor is available as the line feed motor 40. The platen roller 11 is drivingly rotated by the line feed motor 40 by way of the platen gear 12. The printing sheet P is fed to a position in confrontation with the print head 2 by the rotation of the platen roller 11 for printing inked image on the sheet P. At one lateral side of the platen roller 11, a purge mechanism 15 is provided. This purge mechanism 15 is provided for the purpose of eliminating insufficient ink ejection due to the generation of the bubbles in the print head or due to adhesion of ink droplet into ink ejection surface, thereby providing sufficient ink ejecting fashion. The purge mechanism 15 is also operated upon changing the print head 2 or ink cartridges 5*a* through 5*d* with a new print head or new ink cartridges in order to smoothly supply ink in the cartridge toward the nozzles of the ink head 2.

The purge mechanism 15 will be described in detail. At a front portion of the purge mechanism 15, a protection cap 16 is provided. The cap 16 is adapted for covering the nozzle surface of the print head 2 when the carriage 3 is moved to the capping position in order to avoid ink drying. At one side of the cap 16, a stop piece 16*a* is suspended, which is adapted to be abutted by the carriage 3, when the carriage 3 is moved toward the capping region. Further, at another side of the cap 16, the one side being toward the printed region, a suction cap 20 is provided. The purge mechanism 15 also includes a pump 17 which generates a negative pressure, and the suction cap 20 is in communication with the pump 17. When the nozzle of the print head 2 is covered by the suction cap 20, an internal bubbles or inadequate ink in the print head 2 is subjected to sucking by the negative pressure, whereby the print head 2 can be recovered. An ink accumulating tank 18 is provided so as to accumulate ink sucked by the pump 17.

Figure 9:
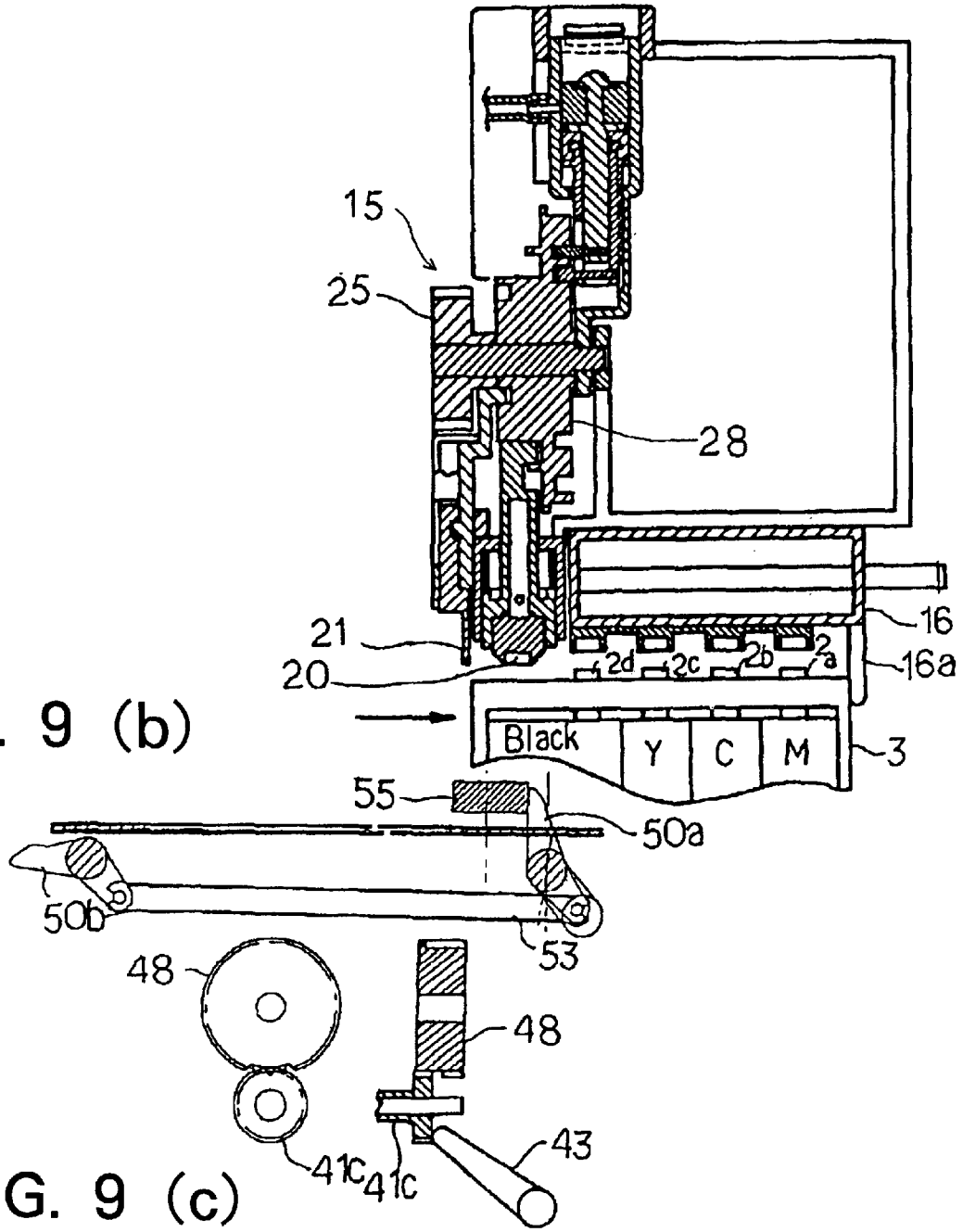
FIG. 9(*a*) is a cross-sectional view showing an internal arrangement of the purge mechanism.

A wiper 21 is disposed beside the suction cap 20 for wiping the nozzle surface of the print head 2. The above described ink sucking operation and wiping operation are performed sequentially with respect to each one of the four nozzles of the print head 2. These maintenance work (suction and wiping) are performed during a single rotation of a pump cam 28 (FIG. 9). As a drive source of the purge mechanism 15, the above described line feed motor 40 is used which is also used for driving the platen roller 11. The power transmission from the line feed motor 40 to the purge mechanism 15 is made in accordance with a position of the carriage 3. A pump cam gear 25 is provided for transmitting the driving power of the line motor 40 to the purge mechanism 15. The pump cam gear 25 is provided integrally rotatably with the pump cam 28 for driving the latter.

Further, at a position opposite the purging mechanism 15, an ink absorbing member 100 is provided for ejecting flashing ink into the nozzles as shown in FIGS. 2 and 13. That is, the ink absorbing member 100 is positioned on a flashing position where nozzles of the print head 2*a* through 2*d* are brought into confrontation with the ink absorbing member 100 for ejecting flashing ink into the nozzles.

Figure 3:
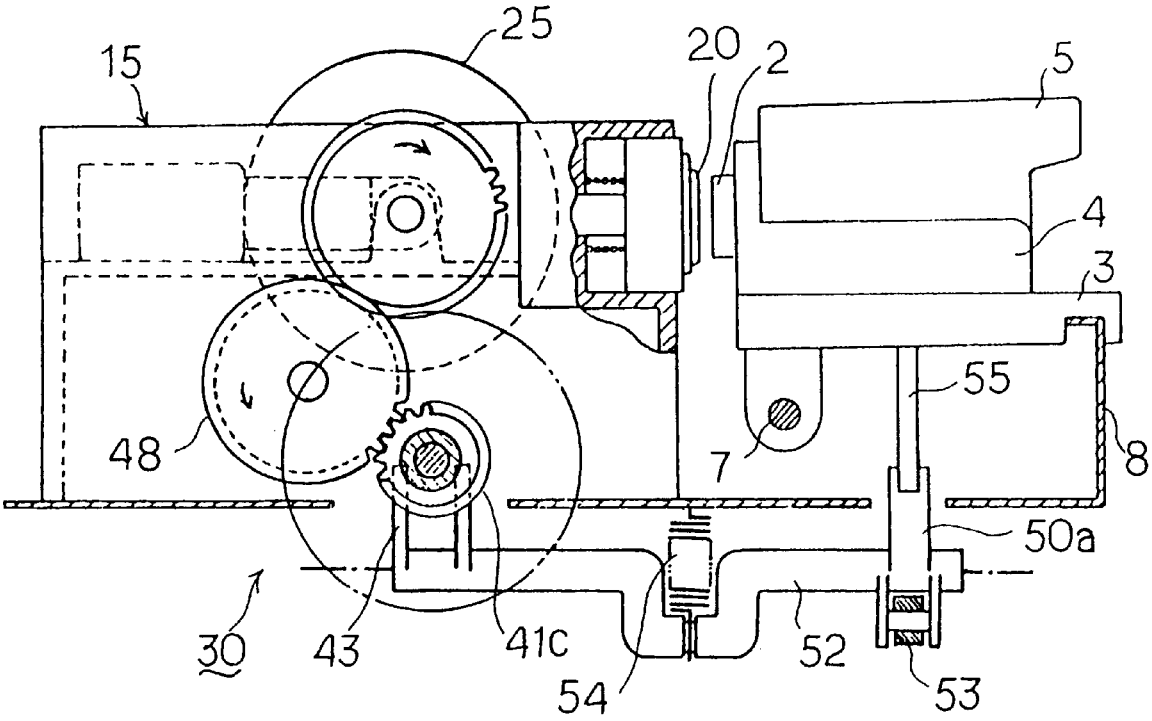
FIG. 3 is a side view with a part being cross-sectioned showing the change-over mechanism according to the first embodiment, a carriage, and a purge mechanism.
Figure 4:
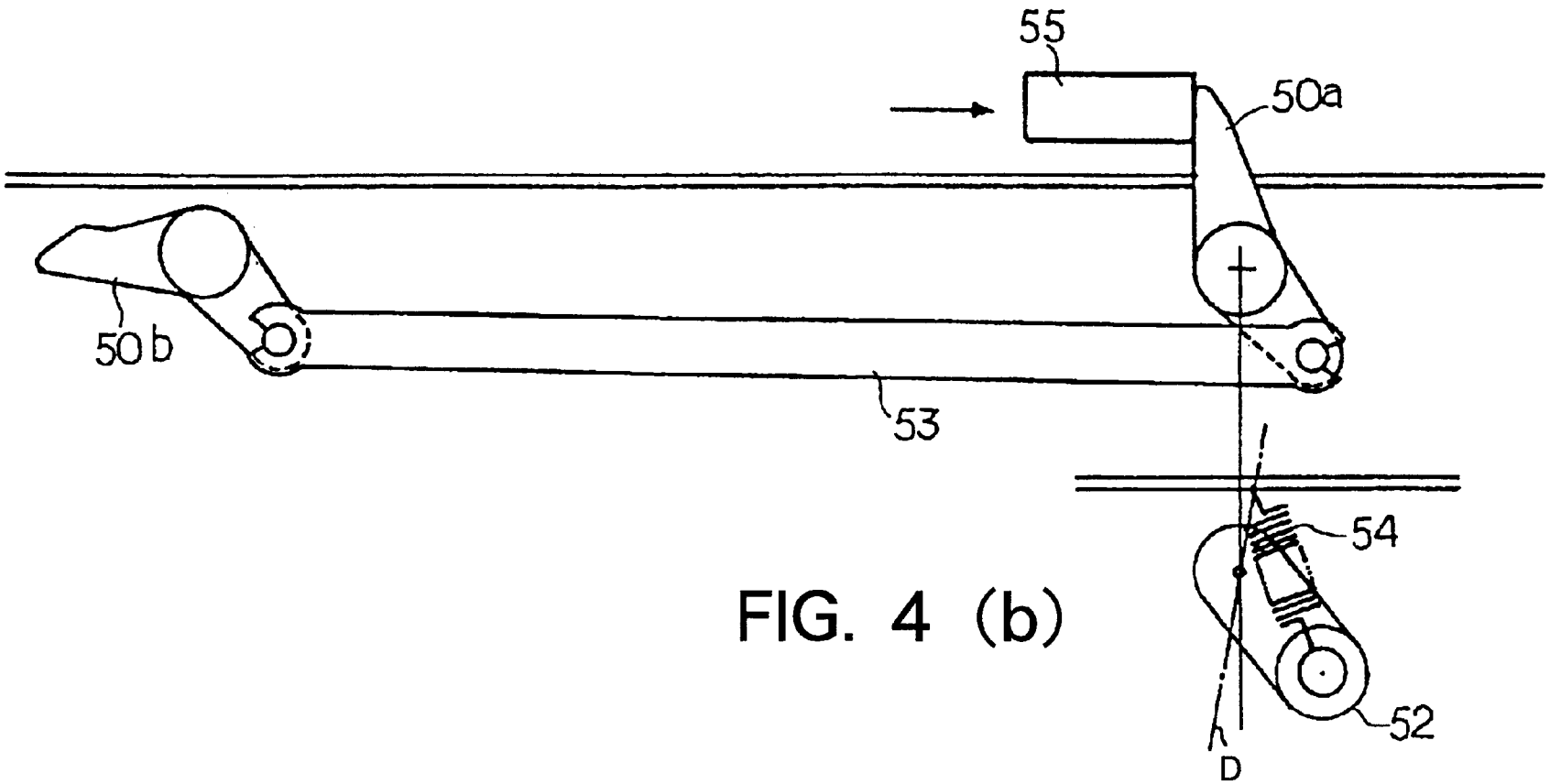
FIG. 4(*a*) is a view for description of a geometrical relationship among a rib, a first reclinable portion, and a second reclinable portion before the carriage enters a capping region according to the first embodiment.
Figure 5:
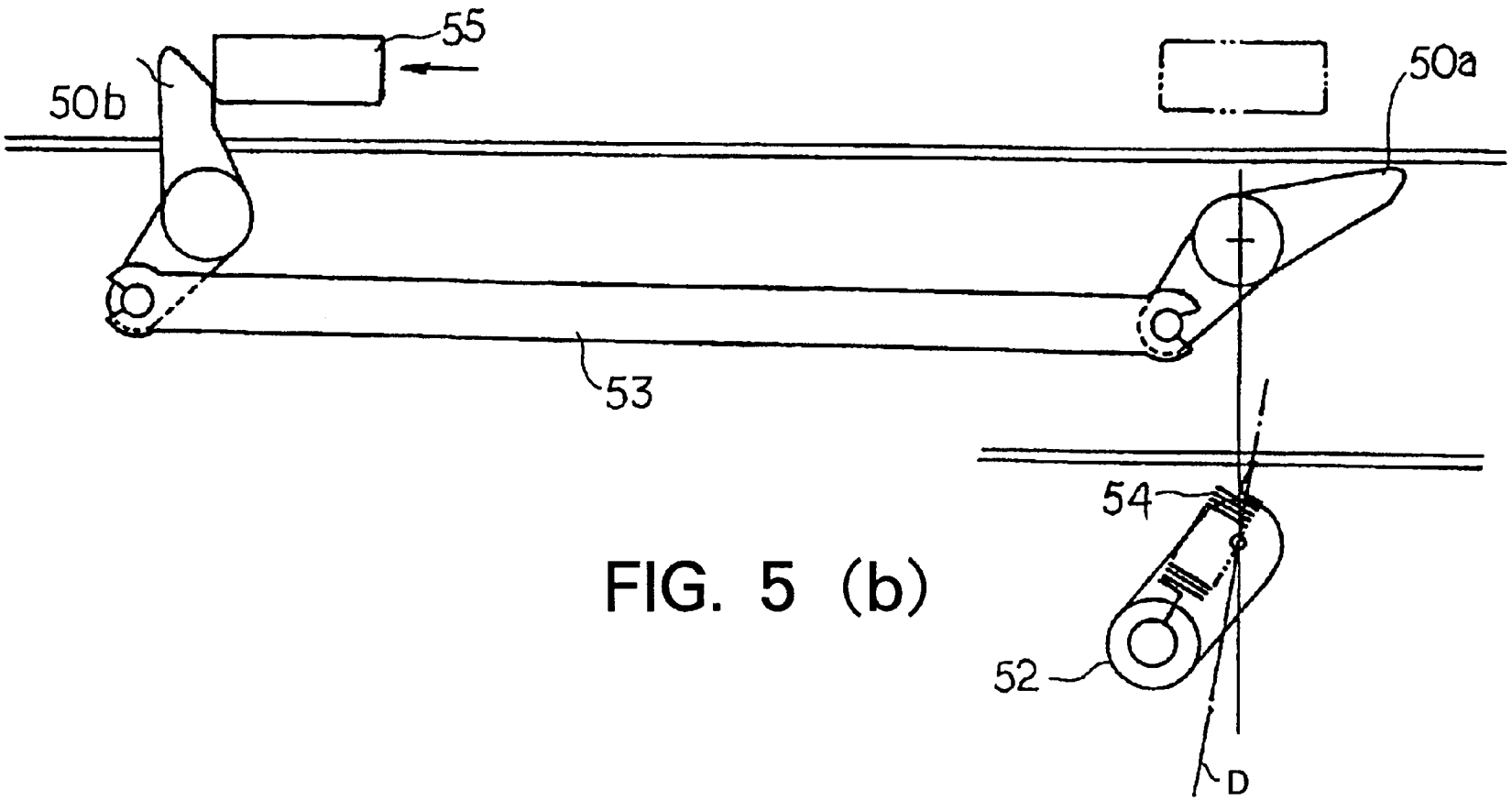
FIG. 5(*a*) is a view for description of a geometrical relationship among the rib, the first reclinable portion and the second reclinable portion according to the first embodiment after the carriage goes out of the capping region and further moves toward a printing region.

Next will be described detailed arrangement of the change-over mechanism for changing-over the power transmission from the line feed motor 40 to the purge mechanism 15 in accordance with the position of the carriage 3. Component used in the change-over mechanism are shown in FIGS. 2 and 3. Further, FIG. 4 shows a geometrical relationship among these components before the carriage 3 enters the capping region, and FIG. 5 shows the geometrical relationship among these components after the carriage goes out of the capping region and moves toward the printing region.

The change-over mechanism 30 includes a power distribution gear 41, an idle kicker 43 and a compression spring 45. The power distribution gear 41 is movable in its axial direction (in a direction by arrow A1 and A2 shown in FIG. 2). The idle kicker 43 is adapted for urging the power distribution gear 41 in the axial direction. The compression spring 45 is adapted to urge the power distribution gear 41 in a direction A1 shown in FIG. 2.

The power distribution gear 41 includes first gear 41*a*, second gear 41*b* and a third gear 41*c*, those being arranged coaxially with one another. The line feed motor 40 has an out put shaft to which a motor gear 46 is coupled. Further, a purge gear 48 is meshingly engaged with the pump cam gear 25. The first gear 41*a* is always meshingly engaged with the motor gear 46, and the second gear 41*b* is always meshingly engaged with the platen gear 12. On the other hand, the third gear 41*c* is selectively meshingly engaged with the purge gear 48 when the carriage 3 moves into the capping region. Thus, the platen is rotatable through the motor gear 46, the fist gear 41*a*, the second gear 41*b*, and the platen gear 42. On the other hand, the purge mechanism 15 is driven by the rotation of the line feed motor 40 through the motor gear 46, the first gear 41*a*, the third gear 41*c*, the purge gear 48, and the pump cam gear 25.

A kicker shaft 52 is rotatably supported to a frame (not shown) of the printer. The kicker shaft 52 has an intermediate portion provided with a crank portion 52A, one end portion integrally provided with an idle kicker 43, and another end portion integrally provided with a first reclinable portion 50*a*. The idle kicker 43 can be pivotable to a position shown by a solid line in FIG. 2 or to a position shown by a broken line in FIG. 2 because of the rotation of the kicker shaft 52 about its axis. At a position beside the kicker shaft 52 and toward the printing region side, another kicker shaft 52*a* is rotatably provided. The other kicker shaft 52*a* integrally provides a second reclinable portion 50*b*. The first reclinable portion 50*a* has oppositely extending leg portion 50*c*, and second reclinable portion 50*b* has oppositely extending leg portion 50*d*. The leg portions 50*c* and 50*d* are connected together by a link member 53. With this arrangement, the angular movement of the first or the second reclinable portions 50*a* or 50*b* will cause angular movement of the second reclinable portion 50*b* or the first reclinable portion 50*a* by way of the link member 53.

A tension spring 54 is interposed between the crank portion 52A and the frame (not shown) of the printer. Pivotally moving posture of the crank portion 52A can be fixed at two position with respect to a neutral line D of the tension spring 54. In other words, the tension spring 54 performs clicking or position fixing function. The neural line D indicates a dead point of the tension spring 54 so that the angular rotational position of the crank portion 52*a* can be fixed at two positions by the pivotal movement of the tension spring 54 when the latter exceeds or passes through the dead point. This implies that posture of the first reclinable portion 50*a* can be defined stably by the tension spring 54 to provide stabilized movement of the power distribution gear 41. Further, the extending direction of the first and the second reclinable portions 50*a* and 50*b* are so defined that, if one kick portion has an upstanding posture, the other kick portion has a falling or lying posture by the linking member 53 and the tension spring 54.

The posture of these kick portions can be fixed by the tension spring 54 once the tension spring 54 exceeds the dead point. Further, the biasing force of the tension spring 54 is greater than the biasing force of the compression spring 45 which urges the power distribution gear 41 in its axial direction. FIG. 28 is a linear graph showing the biasing force of the tension spring 54 relative to the biasing force of the compression spring 45. The linear graph shows that the biasing force of the tension spring 54 is greater than the biasing force of the compression spring 45. The idle kicker 43 is adapted to urge the power distribution gear 41, i.e., is adapted to press the third gear 41*c* toward a direction A2 against the biasing force of the compression spring 45, when the kicker shaft 52 is rotated about its axis so that the idle kicker 43 has the orientation shown in the solid line in FIG. 2.

Extending direction of the idle kicker 43 with respect to the kicker shaft 52 is so defined that, the idle kicker 43 has a posture shown in solid line in FIG. 2 when the first reclinable portion 50*a* has the upstanding posture, and has the broken line posture when the second reclinable portion 50*b* has its upstanding posture. The first reclinable portion 50*a* maintains its upstanding position, if the carriage 3 is at printing region. Further, the first reclinable portion 50*a* and the second reclinable portion 50*b* can be projectable into a moving stroke area of the carriage 3.

The first reclinable portion 50*a* is positioned at immediately before the starting point of the capping area, while the second kicking portion 50*b* is positioned in the printing region. The carriage 3 has a bottom portion provided with a rib or an abutting portion 55. The rib 55 can be brought into abutment with the first reclinable portion 50*a* and the second reclinable portion 50*b* to change their orientation or posture. Incidentally, though FIG. 2 shows an exploded segmental view, in fact these components are provided closely with one another.

Since the first reclinable portion 50*a* is not positioned within the printing region but is positioned at a boundary between the printing region and the capping region, the first reclinable portion 50*a* is kicked down when the carriage 3 is moved toward the outside of the printing region. Accordingly, the first reclinable portion 50 is not kicked down during movement of the carriage in the printing region for printing operation. Thus, the power transmission to the purging mechanism 15 is achieved only when the recovery operation is required.

Figure 6:
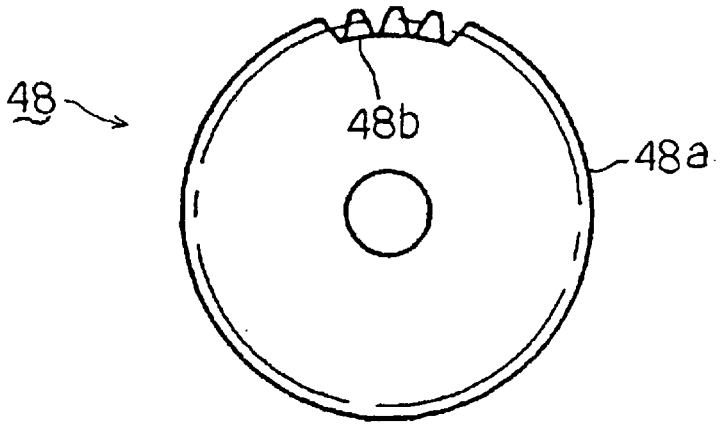
FIG. 6(*a*) is one side view showing a purge gear or a negative pressure gear according to the first embodiment.
Figure 6:
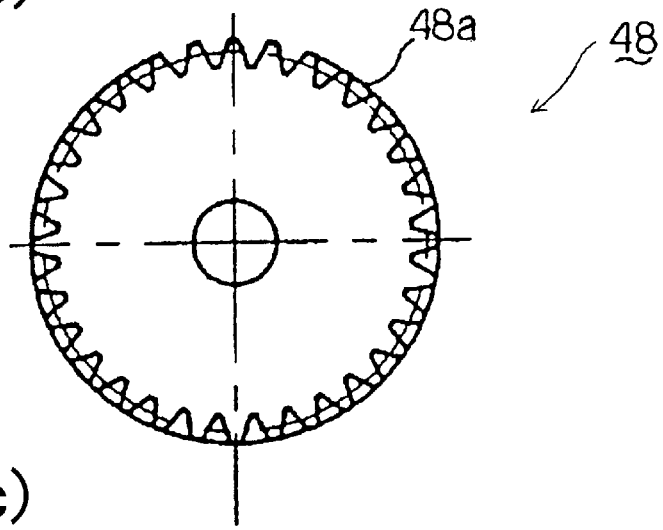
Figure 6:
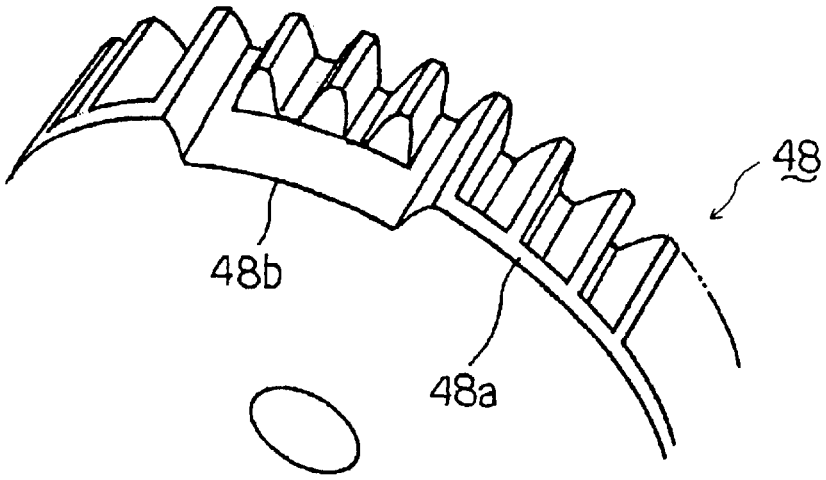

Next, a configuration of the purge gear 48 will be described with reference to FIG. 6. At one axial side of the purge gear 48, a flange 48*a* is provided integrally with the axial side face of each gear tooth. The flange 48*a* is positioned to one axial side of the gear 48, which side is close to the power distribution gear 41. Further, the flange 48*a* is formed with a notched portion 48*b*. Movable length or distance of the power distribution gear 41 is adjusted by a proper stop member (not shown) so as to allow the third gear 41*c* to be still stayed on the notched portion 48*b* even when the third gear 41*c* is disengaged from the purge gear 48. The change-over operation can be performed in a stabilized fashion by the simple sliding movement of the power distribution gear 41.

The sliding movement of the power distribution gear 41 is performed on the notched portion 48*b* of the purge gear 48 so that the power distribution gear 41 can be brought into engagement with or disengaged from the purge gear 48 yet the third gear 48*c* is still on the notched portion 48*b*. Therefore, the third gear 41*c* can be smoothly slidingly moved to engage the purge gear 48 in the next purging operation, and slide-moving length and period of the power distribution gear 41 can be reduced. Further, since the flange portion 48*a* serves as a stop member for preventing the third gear 41*c* from being released from the purge gear 48 if the notched portion 48*b* is not rotationally aligned with the third gear 41*c*. Therefore, driving power from the line feed motor 41 can surely be transmitted to the purging mechanism 15.

Next, will be described the movement of respective kick portions 50*a*, 50*b* in accordance with the movement of the carriage 3 and the power transmission mode by the above described gears 12, 41, 46, 48, 25. If the carriage 3 is in the printing region, the idle kicker 43 is positioned shown by the solid line in FIG. 2 because of the orientation and biasing force of the tension spring 54. In this case, the idle kicker 43 pushes the power distribution gear 41 in the direction A2 against the biasing force of the compression spring 45. Therefore, the third gear 41*c* is disengaged from the purge gear 48, and accordingly, the pump cam gear 25 can not be driven.

On the other hand, if the carriage 3 moves into the capping region, the rib 55 kicks the first reclinable portion 50*a* to fall down the same, thereby providing the broken line position of the idle kicker 43 shown in FIG. 2. Consequently, the drive distribution gear 41 is released from the idle kicker 43. In this instance, the power distribution gear 41 is movable in the direction A1 because of the biasing force of the compression spring 45, whereupon the third gear 41*c* is brought into meshing engagement with the purge gear 48. By this meshing engagement, driving power from the line feeding motor 40 can be transmitted to the pump cam gear 25 thereby performing suction through the suction cap 20 of the purge mechanism 15.

When the carriage 3 is to be moved toward printing region, the second reclinable portion 50*b*, which had been raised by falling down the first reclinable portion 50*a* when the carriage 3 goes into the capping area, is kicked by the rib 55. Thus, the idle kicker 43 moves to the position shown by the solid line, so that the power distribution gear 41 is urged by the idle kicker 43 in the direction A2. Because the power distribution gear 41 is pushed in a direction A2, the third gear 41*c* is disengaged from the purge gear 48.

Figure 7:
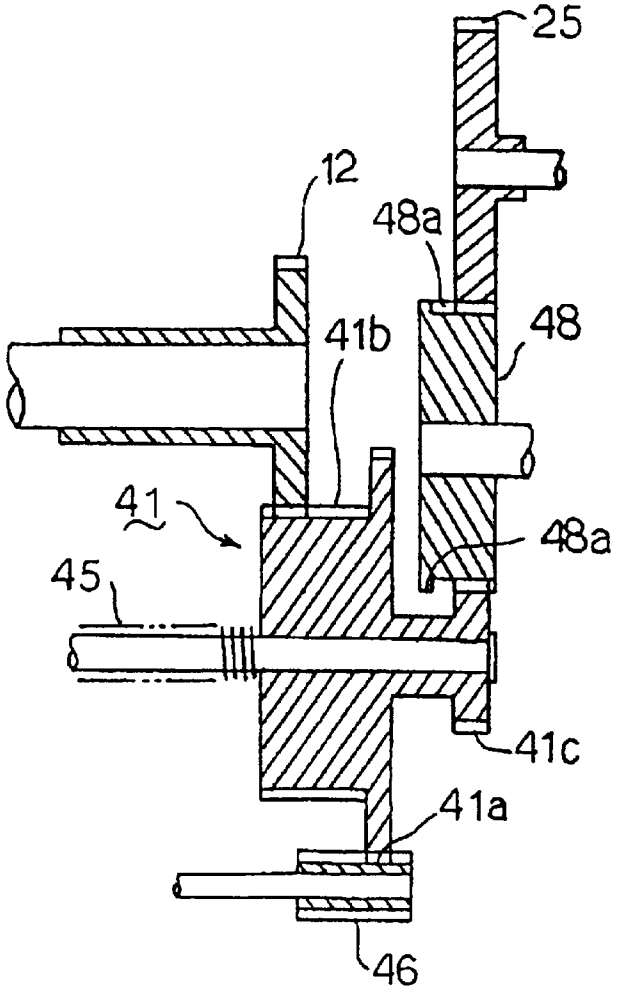
FIG. 7(*a*) is a cross-sectional view showing the meshing relation among a platen gear or a feed gear, a pump cam gear, a power distribution gear, a motor gear and the purge gear, and showing a state where the purge gear is engaged with the power distribution gear.
Figure 7:
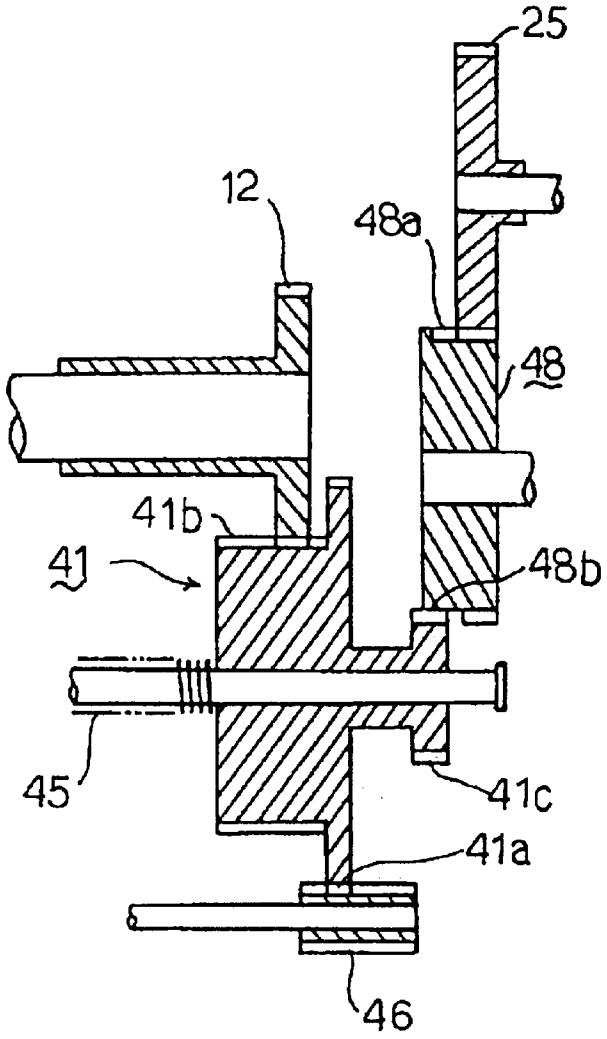

Next, the engaging relationship among the platen gear 12, the pump cam gear 25, the power distribution gear 41, the motor gear 46, and the purged gear 48 will be described with reference to FIG. 7. Even if the third gear 41*c* of the power distribution gear 41 disengaged from the purged gear 48, the third gear 41*c* is still positioned on the notched portion 48*b* of the purged gear 48. In this case, the first gear 41*a* is engaged with the motor gear 46, the second gear 41*b* is engaged with platen gear 12, and the purged gear 48 is engaged with the pump cam gear 25 as shown in FIG. 7(*a*). If the third gear 41*c* is brought into meshing engagement with the purge gear 48, because the power distribution gear 41 is slidingly moved toward the purge gear 48 as shown FIG. 7(*b*), the remaining gears are maintained engaged with each other.

Figure 8:
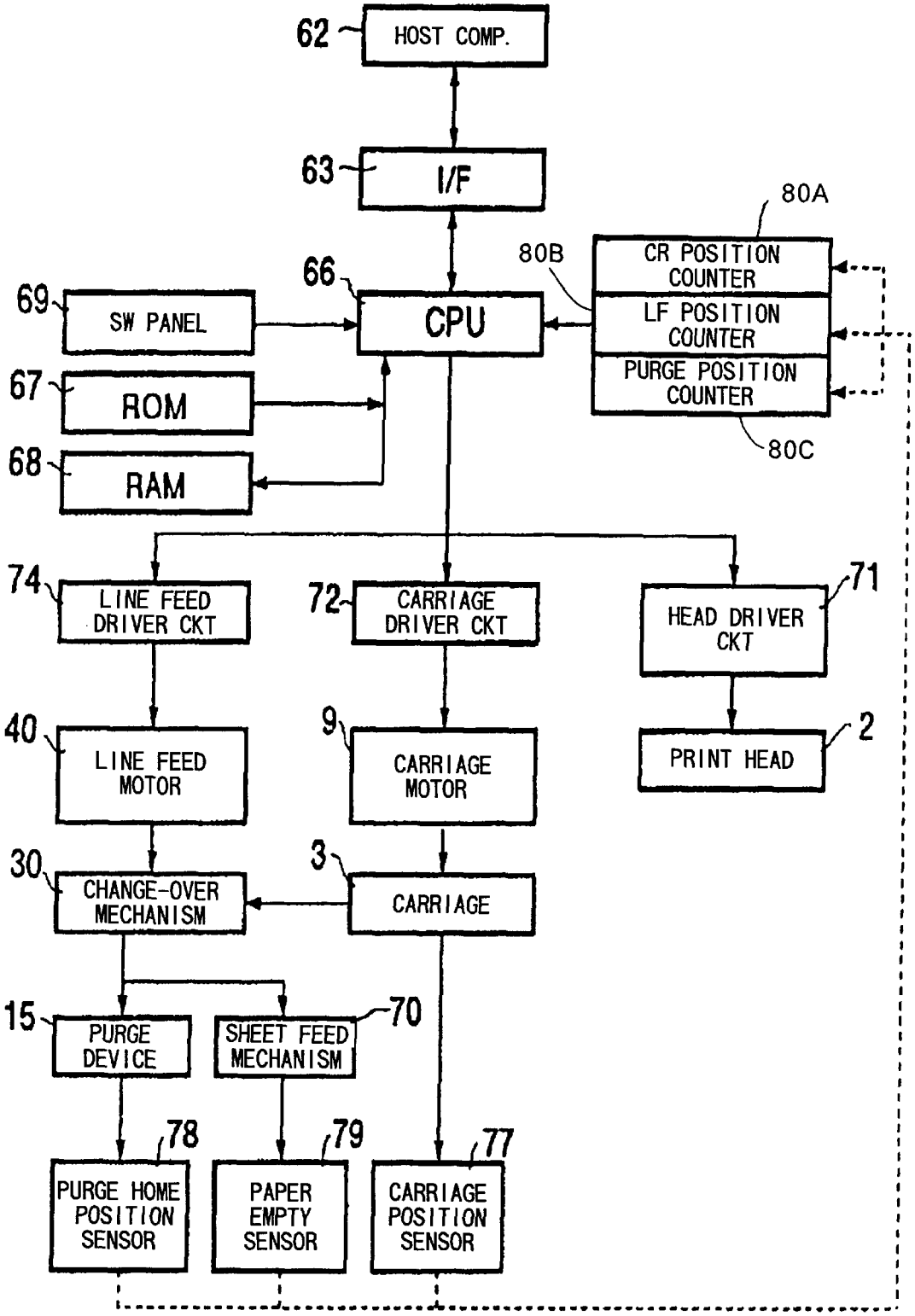
FIG. 8 is a block diagram showing electrical circuit for controlling the change-over mechanism according to the first embodiment.

A printer control system will next be described with reference to FIG. 8. The printer 1 has a CPU or a control portion 66 connected to a host computer 62 through an interface 63. The CPU 66 is adapted for controlling overall operation of the printer based on print data transmitted from the host computer 62. The printer 1 also has a ROM 67 and a RAM 68 those connected to the CPU 66. The ROM 67 is adapted for storing therein necessary programs for control processing, and the RAM 68 is adapted for temporarily storing therein print data, etc., received from the host computer 62. A switch panel or a keyboard 69 is connected to the CPU 66 for inputting therein a command signal.

The printer 1 includes the above described print head 2, the carriage 3, the purge mechanism 15, and a sheet feed mechanism 70 including the platen 11 and the platen gear 12. The printer also includes a head driver circuit 71 connected to the CPU 66 for driving the print head 2, a carriage driver circuit 72 connected to the CPU 66 for driving the carriage 2, and a line feed motor driver circuit 74 connected to the CPU 66 for driving the line feed motor 40. Thus, the print head 2, the carriage motor 9 and the line feed motor 40 are driven under the control of the CPU 66.

Under the control by the CPU 6, the line feed motor 40 is driven through the line feed motor driver circuit 74, so that the sheet feed mechanism 70 and the purge mechanism 15 can be operated by way of the change-over mechanism 30. A carriage position sensor 77 is provided for detecting a position of the carriage 3. The carriage position sensor 77 is connected to a carriage position counter 80A connected to the CPU 66 so that a position detection signal generated in the sensor 77 can be transmitted to the counter BOA and to the CPU 66. Further, a paper empty sensor 79 is provided nearby the sheet feed mechanism 70 so as to detect the position of the printing sheet P. The paper empty sensor 79 is connected to a line feed position counter 80B connected to the CPU 66. Furthermore, a purge home position sensor 78 is provided nearby the purge mechanism 15 so as to detect operation phase of the purge mechanism 15. The purge home position sensor 79 is connected to a purge position counter 80C connected to the CPU 66. Accordingly, carriage position signal, paper detection signal, and the purge position signal are used for controlling operation of the carriage 3, the purge mechanism 15 and the sheet feed mechanism 70.

Next, will be described operation of the carriage 3 and change-over mechanism 30 for performing maintenance to the nozzles of the print head 2 with reference to FIG. 9 through 19.

If the carriage 3 moves toward the capping position and is about to be moved into the capping region, the carriage 3 abuts the stop piece 16*a* of the cap 16 for starting capping operation as shown in FIG. 9. In this case, the rib 55 is brought into abutment with the first reclinable portion 50*a*, so that latter is about to be falling down. If the carriage 3 further moves rightwardly as shown in FIG. 10 and reaches a stroke end of the carriage 3 (capping position), capping to one of the print head 2*a* through 2*d* by the cap 16 is completed. In this case, the rib 55 kicks down the first kicks portion 50*a,* so that the idle kicker 43 is pivotally moved in a clockwise direction in FIG. 10(*b*) while the tension spring 54 exceeds its dead point to change its orientation. Accordingly, the idle kicker 43 is moved away from the third gear 41*c* of the power distribution gear 41. Consequently, the third gear 41*c* which has been positioned on the notched portion 48*b* of the purged gear 48 is moved rightwardly in FIG. 10 on the notched portion 48*b* because of the biasing force of the compression spring 45. Thus, the third gear 41*c* is brought into meshing engagement with the purge gear 48 as shown in FIG. 10(*d*). Further, in synchronization with the falling down movement of the first reclinable portion 50*a,* the second reclinable portion 50*b* is pivotally moved to its upstanding portion shown in FIG. 10(*b*).

Then, in order of perform sucking operation to the nozzles of the print head 2*a,* the carriage 3 is moved leftwardly as shown in FIG. 11(*a*), so that the nozzle of the print head 2*a* is moved to a position in confrontation with the suction cap 20 of the purge mechanism 15, the suction position being located in the printing area. Incidentally, by disposing the purge mechanism 15 in the printing area, entire size of the printer 1 can be reduced. In this case, the carriage 3 is moved into the printing area. However the carriage 3 has not yet been moved to a position where the rib 55 can kick the second reclinable portion 50*b*. Accordingly, the idle kicker 43 is still positioned away from the third gear 41*c*. Therefore, the third gear 41*c* is still engaged with the purged gear 48 as shown in FIG. 11(*d*).

In a state where the nozzles of the print head 2*a* confront the suction cap 20, the line feed motor 40 is energized to rotate the third gear 41*c,* to thus provide a single rotation of the purge gear 48. By this rotation, the purge mechanism 15 is actuated, so that the suction cap 20 moves toward the nozzles of the print head 2*a* and sucking operation by the suction pump is performed as shown in FIG. 12(*a*-1). When the sucking operation is completed, the suction cap 20 is moved away from the print head 2*a* and then, the wiper 21 is moved toward the print head 2*a* and contacts the nozzle of the print head 2*a*. Then, the carriage 3 is moved by a distance L leftwardly for wiping the print head 2*a* as shown in FIG. 12(*a*-2) and (*a*-3). After the wiping operation, the wiper 21 is moved away from the print head 2*a* as shown in FIG. 12(*a*-4). Here, because the purge gear 48 is rotated by 360 degree only, the notched portion 48*b* of the purged gear 48 is returned to a purge home position in respect to the third gear 41*c*.

Then, the carriage 3 is moved to the left most position of the printing region (i.e., flashing position) where nozzles of the print head 2*a* of 2*d* is brought into confrontation with the ink absorbing member 100 for ejecting flashing ink into the nozzles as shown in FIG. 13. During the leftward movement of the carriage 3, the second reclinable portion 50*b* is kicked down by the rib 55 while the first reclinable portion 50*a* is moved to its upstanding portion. In response to the pivotal movement of the first reclinable portion 50*a,* the idle kicker 43 is pivotally moved in a counterclockwise direction shown in FIG. 13(*d*), so that the third gear 41*c* is urged leftwardly as shown in FIG. 13(*d*). As described before, because the notched portion 48*b* of the purged gear 48 is in alignment with the third gear 41*c,* the third gear 41*c* can be movable along the notched portion 48*b* and disengaged from the purge gear 48.

Upon completion of the flashing operation, the carriage 3 is again moved to the capping portion as shown in FIG. 14. During this movement of the carriage 3, the first reclinable portion 50*a* is kicked down by the rib 55, and simultaneously, the second reclinable portion 50*b* is moved to its upstanding position. Accordingly, the idle kicker 43 is moved in a clockwise direction in FIG. 13, so that the third gear 41*c* is free from the restriction by the idle kicker 43 and is again brought into engagement with the purge gear 48 by the biasing force of the compression spring 45.

Figures 16A, 16B, 16C, 16D:
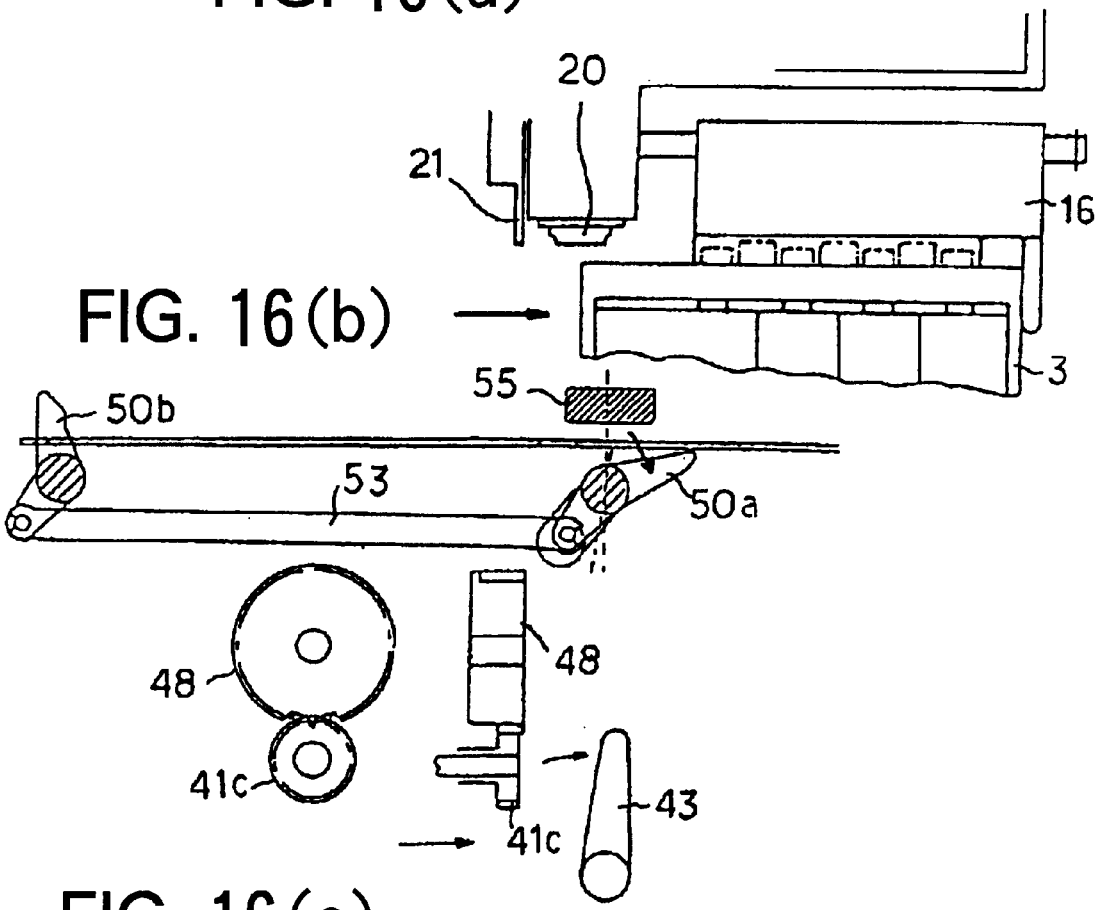
FIGS. 16(*a*) through 16(*d*) are views substantially the same as those shown in FIGS. 10(*a*) through 10(*d*), but showing a state where all print heads have been subjected to purging and flashing, and the carriage reaches the capping region.

After the carriage 3 is moved to its capping position, the carriage 3 is moved toward the printing area in order to perform a sucking operation with respect to the nozzles of the print head 2*b* as shown in FIG. 15. Then, similar to the operation with respect to the print head 2*a*, a sequential operation of sucking, wiping and flashing to the print head 2*b* are performed. Thereafter, the similar operation are performed with respect to the remaining nozzles of the print head 2*c* and 2*d,* and then, the carriage 3 is moved to the capping position. Then, capping is performed with respect to the print head 2*a* through 2*d* by the protection cap 16, and thus, the maintenance work is completed as shown in FIG. 16.

Figures 17A, 17B, 17C, 17D:
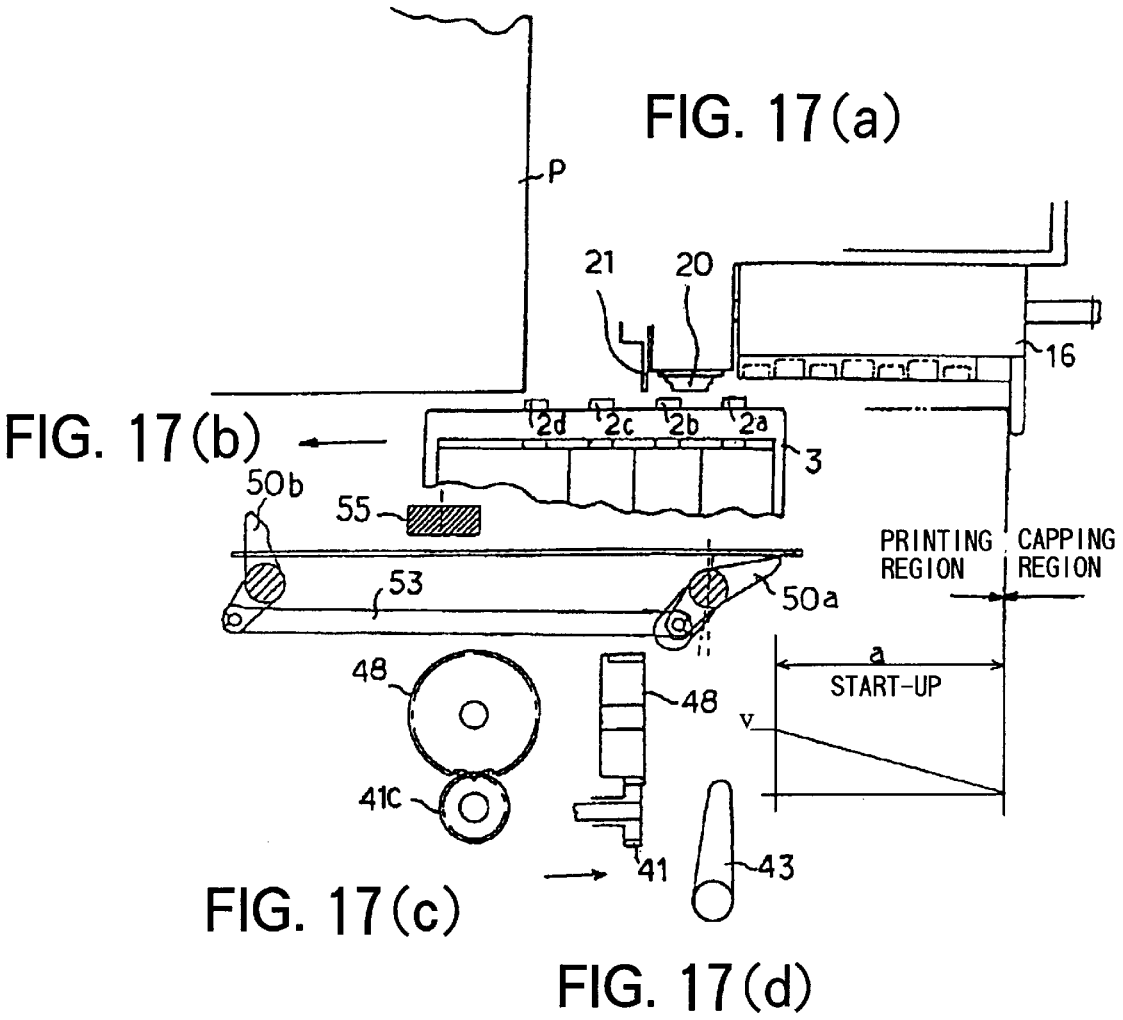
FIGS. 17(*a*) through 17(*d*) are views substantially the same as those shown in FIGS. 11(*a*) through 11(*d*), but showing a state where maintenance to all nozzles were completed and the carriage is moved toward the printing region.

If printing is to be started after the maintenance operation, the carriage 3 is moved into the printing area (leftwardly in FIG. 17). Here, because the second reclinable portion 50*b* is located in the printing area, the second reclinable portion 50*b* is kicked down by the rib 55 after the carriage moves in the printing region for several periods. Therefore, even if the carriage 3 is moved in the printing area, the third gear 41*c* is still engaged with the purge gear 48 as long as the carriage 3 is positioned in a given printing area (as long as the second reclinable portion 50*b* has not yet been kicked down by the rib 55) as shown in FIG. 17.

This implies that even if the purging mechanism is positioned within the printing region due to the requirement of downsizing of the entire printer, purging operation can be performed even in the printing region. Further, even if a plurality of print heads are juxtaposedly arranged in the running direction of the carriage 3, recovery operation can be made to all nozzles of the print heads even during the movement of the carriage toward the printing region.

Figures 18A, 18B, 18C, 18D:
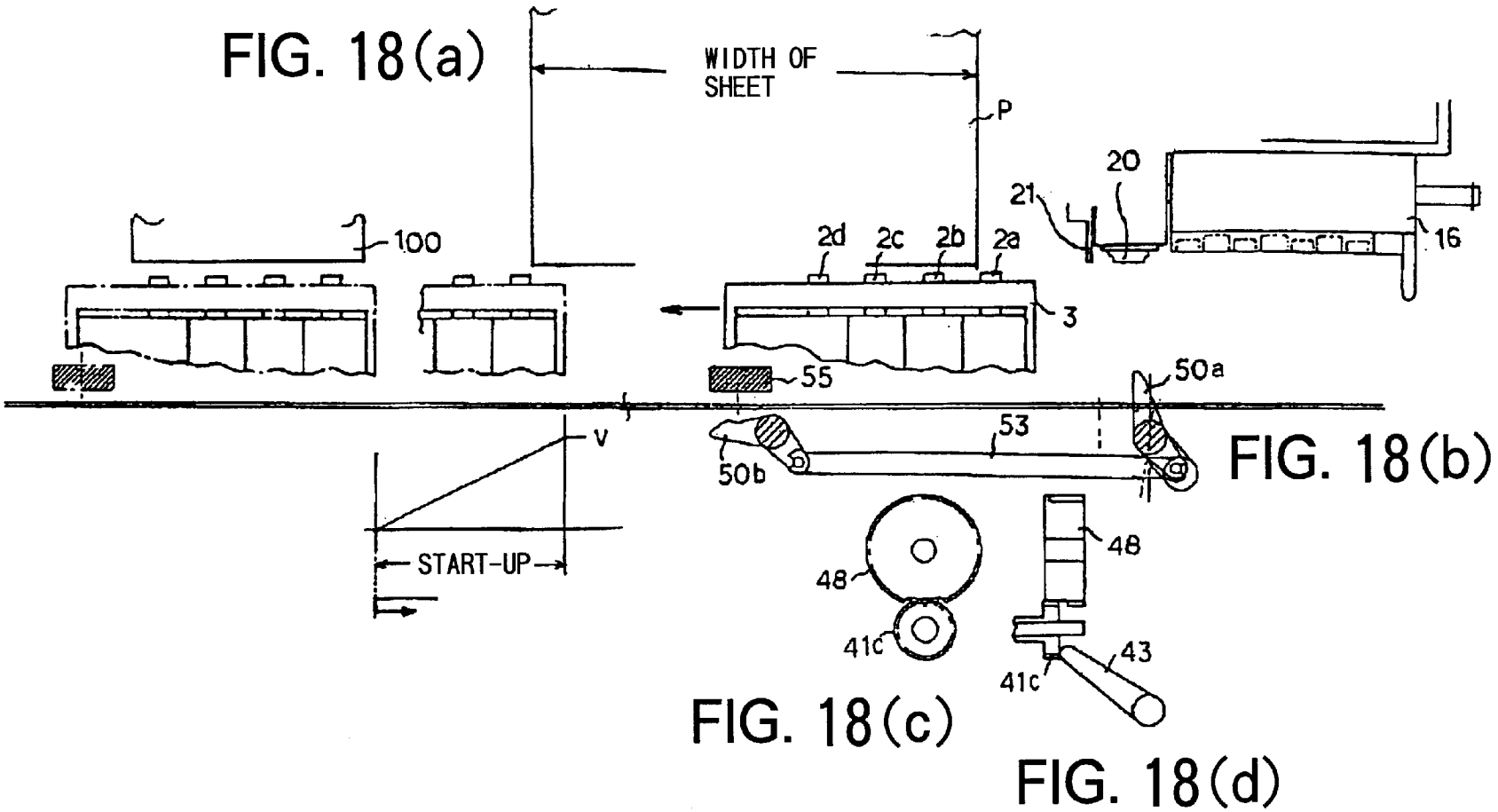
FIGS. 18(*a*) through 18(*d*) are views substantially the same as those shown in FIGS. 13(*a*1) through 13(*d*), but showing a state where the carriage is temporarily moved toward the printing region for kicking down the second reclinable portion.
Figures 19A, 19B, 19C, 19D:
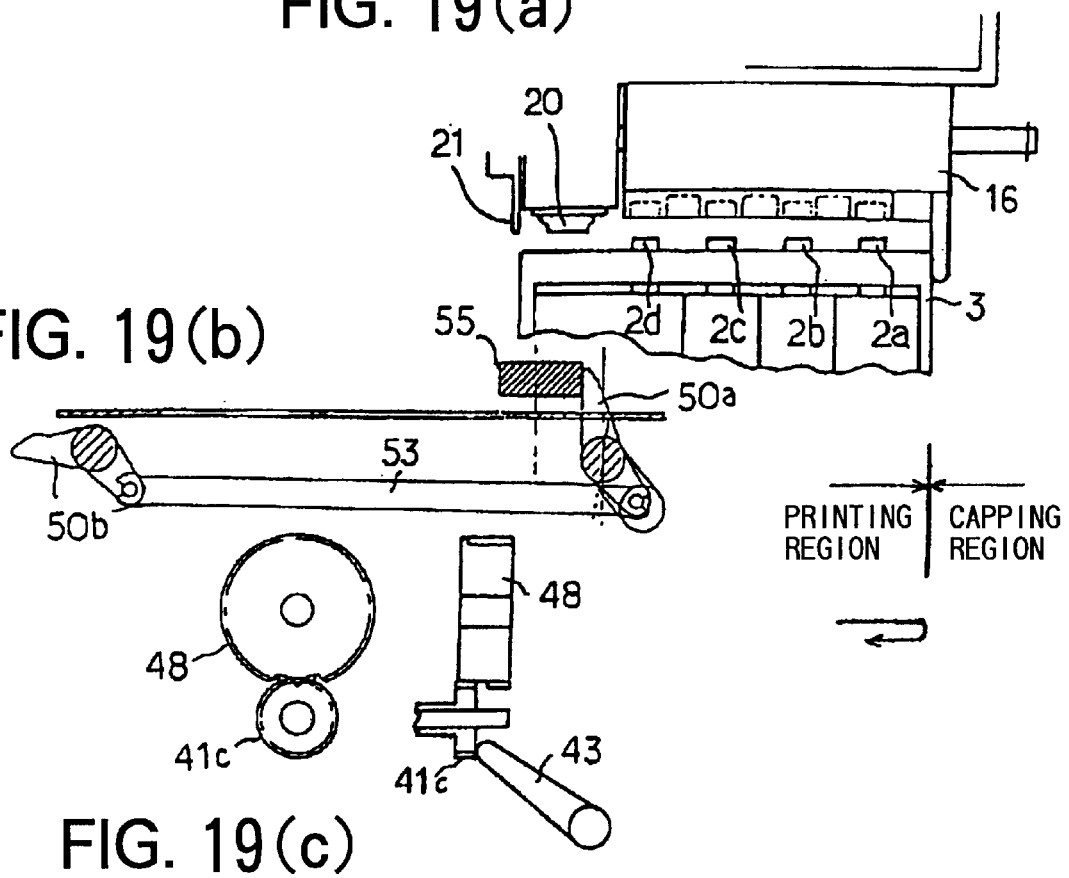
FIG. 19(*a*) is a view for description of the positional relationship between the carriage and the purge mechanism when the carriage is moved and stopped at immediately before the entry of the capping region.

Then, the carriage 3 is further moved leftwardly so that the second reclinable portion 50*b* can be kicked down by the rib 55 in order to disengage the third gear 41*c* from the purge gear 48 as shown in FIG. 18. Then, the carriage 3 is moved to the capping start position, i.e, the rightmost end of the printing area as shown in FIG. 19, and then the printing is started from this position.

However, this operation is only required when the carriage 3 is moved from the right end to the left end for starting printing operation in a monochromatic printing (only black ink in used) in case printing is performed in accordance with bi-directional movement of the carriage 3. If a home position of the carriage 3 is determined at the leftmost end of the printer 1, and if the printing is only performed when the carriage is moved rightwardly in case of, for example, color printing, the carriage 3 is only moved leftwardly to the home position without printing after maintenance work so as to start subsequent printing. During this return stroke of the carriage, the second reclinable portion 50*b* can be falling down, so that the third gear 41*c* can be disengaged from the purged gear 48. Accordingly, in case of the color printing, the above described intricate movement of the carriage becomes unnecessary.

During printing operation, the carriage 3 performs reciprocal movement in the printing area. In other words, the carriage does not enter the capping region, and therefore the rib 55 does not kick down the first reclinable portion 50*a*. As a result, the purge mechanism 15 is not actuated. Further, the actual printing is performed when the carriage is moved leftwardly from the position shown in FIG. 17. As shown in FIG. 17, a start-up region "a" is provided in the printer 1 in order to accelerate the carriage 3 and provide a constant speed thereof after the return movement of the carriage 3.

Next, operation of the change-over mechanism 30 will be described with reference to FIG. 20 after shutting off the electrical power supply to the printer 1 during the maintenance work and an operator inadvertently moves the carriage manually which had been positioned on the sucking position to the printing region.

If the electrical power supply to the printer 1 is shut off during sucking operation, the rotation of the purged gear 48 and the third gear 41*c* will be stopped as shown in FIG. 20(*c*). In this case, the carriage 3 is positioned to the side of the capping position with respect to the second reclinable portion 50*b*. Therefore, the second reclinable portion 50*b* has the upstanding posture. In this case, if the operator inadvertently moves the carriage 3 manually into the printing region, and the rib 55 kicks down the second reclinable portion 50*b*, the first reclinable portion 50*a* is urged to be moved from its falling down position to the upstanding position as shown in FIG. 20(*a*), and the idle kicker 43 is urged to be angularly rotated to push the third gear 41*c* so as to disengage the third gear 41*c* from the purge gear 48 as shown in FIG. 20(*d*).

However, even if the third gear 41*c* is pushed by the idle kicker 43, the third gear 41*c* is brought into abutment with the flange portion 48*a* of the purge gear 48, and accordingly, the third gear 41*c* cannot be disengaged from the purged gear 48. Further, the idle kicker 43 did not sufficiently depress the third gear 41*c*, and therefore, the tension spring 54 has a posture where it slightly exceeds the dead point, and therefore, the first reclinable portion 50*a* cannot sufficiently have its upstanding position as shown in FIG. 20(*b*). While maintaining these states, if the electrical power supply is rendered ON, the purge gear 48 can be smoothly rotated to its home position by the rotation of the line feed motor 40 because the purge gear 48 is engaged with the third gear 41*c*. That is, the purge gear 48 can be rotated so that the notched portion 48*b* can be brought into alignment with the third gear 41*c*.

As described above, because the tension spring 54 has an orientation just exceeding the neutral line D or dead point, the first reclinable portion 50*a* is urged toward its upstanding direction, and therefore, the idle kicker 43 is pivoted in a direction to push the third gear 41*c*. Thus, when the notched portion 48*b* is rotated to a position corresponding to the third gear 41*c*, the third gear 41*c* can be slidingly moved away from the purge gear 48. Further, by this rotation, the first reclinable portion 50*a* can be completely rising up by the biasing force of the tension spring 54, and therefore, the idle kicker 43 and kick portions 50*a* and 50*b* are restored to their normal positions.

In the first embodiment, as described above, the second reclinable portion 50*b* which is adapted for moving the power distribution gear 41 from the engaging position with the purge gear to the disengaging position therefrom is positioned toward the printing region with respect to the first reclinable portion 50*a* which is adapted for moving the power distribution gear 41 from disengaging position from the purge gear 48 to the engaging position therewith. Therefore, if the carriage 3 is moved into the capping region so that the rib 55 kicks down the first reclinable portion 50*a* in order to provide engaging state between the power distribution gear 41 and the purge gear 48, this engagement can be maintained as long as the rib 55 does not kick the second reclinable portion 50*b*. That is, even if the carriage 3 is moved toward the printing region, this meshing engagement can be maintained unless the rib 55 kicks down the second reclinable portion 50*b*. Accordingly, the transmission of the driving power from the line feed motor 40 to the purge mechanism 15 can be maintained for maintenance to the nozzles of the print head, even if the carriage is moved toward the printing region. This is advantageous in a case where the purging mechanism 15 is positioned in the printing region so as to provide a compact printer. In the latter case, purging operation can be performed even if the carriage is moved in the printing region.

Further, after the meshing engagement between the power distribution gear 41 and the purge gear 48 and after the rotation of these gears, these gears are not disengaged from each other even by the kick of the rib 55 against the second reclinable portion 50*b* as long as the notch portion 48*b* of the purge gear 48 is rotationally offset from the third gear 41*c*. That is, even if the third gear 41*c* is to be moved in a disengaging direction from the purge gear 48, the flange portion 48*a* of the purge gear 48 serves as a stop member for preventing the third gear 41*c* from being further moved. This structure is advantageous in that, if the electrical power supply is shut off during the purging operation, and thereafter, the carriage is inadvertently manually moved toward the printing region so that the rib 55 unwantedly kick the second reclinable portion 50*b*, the power distribution gear 41 does not disengage from the purge gear 48. This means that the purge gear 48 can be rotated to its home position by the rotation of the power distribution gear 41 because of the engagement therebetween once the electrical power supply is rendered ON. Therefore, purging operation can be continued.

Furthermore, since the tension spring 54 can provide two biasing directions, i.e., can provide two biasing postures exceeding its neutral line or the dead line. Therefore, two fixed angular positions of the crank portion 52A can be provided, i. e., the first reclinable portion 50*a* can have two fixed angular positions. Accordingly, even if the first reclinable portion 50*a* cannot have its ultimate orientation due to inadvertent manual pushing of the carriage 3 toward the printing region, the tension spring 54 continuously urge the first reclinable portion 50*a* toward its ultimate orientation posture. Consequently, if the notch portion 48*b* is rotationally aligned with the third gear 41*c,* the power distribution gear 48*b* can be quickly moved by the biasing force of the tension spring 54, and the first reclinable portion 50*a* can have its ultimate upstanding posture, whereas the second reclinable portion 50*b* can have its ultimate falling posture. Thus, the change-over mechanism 30 is not damaged due to the inadvertent movement of the carriage toward printing region in electrical power OFF state.

Figure 21:
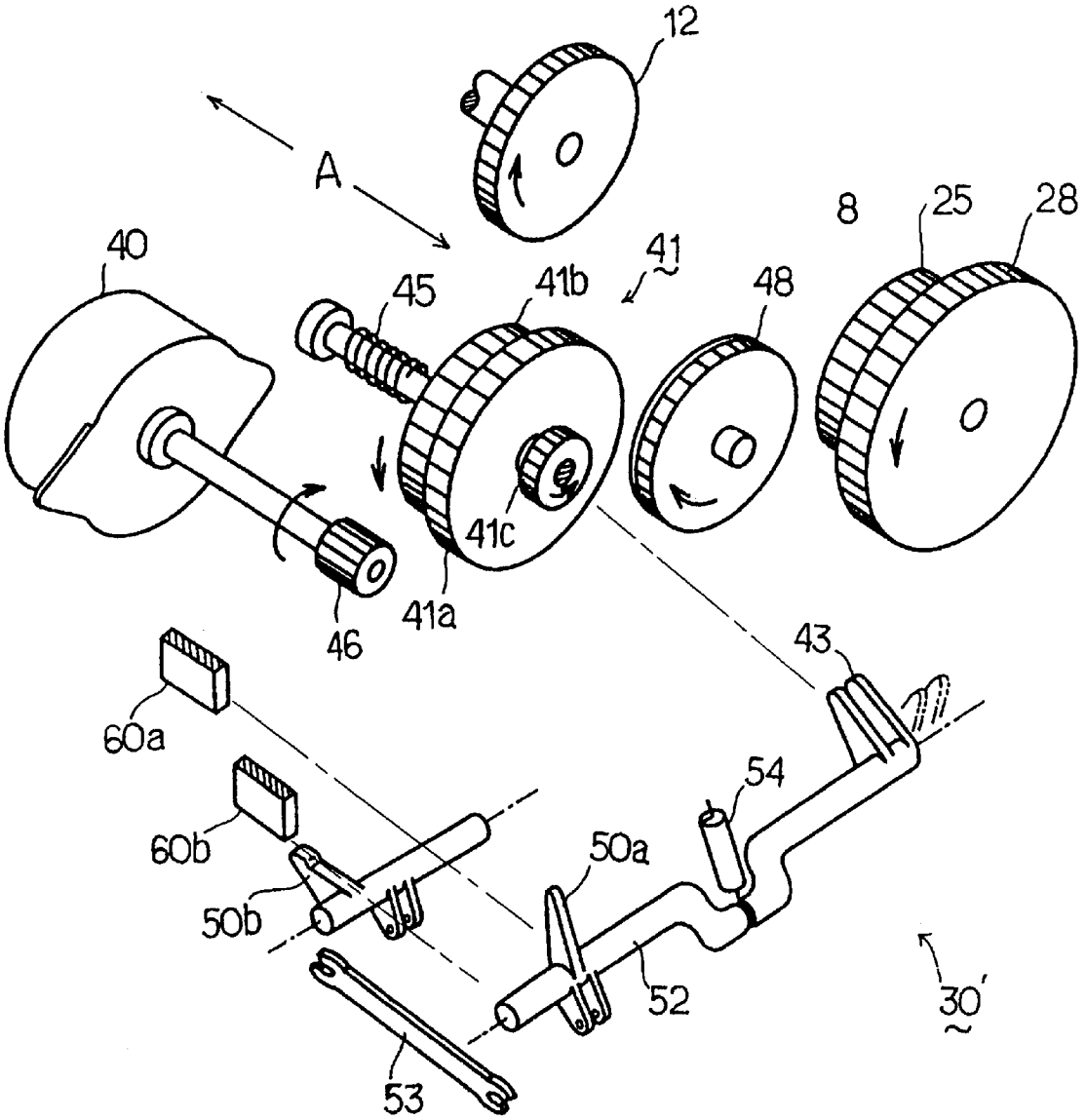
FIG. 21 is a exploded segmental perspective view showing components of a change-over mechanism according to a second embodiment of the present invention.
Figure 22:
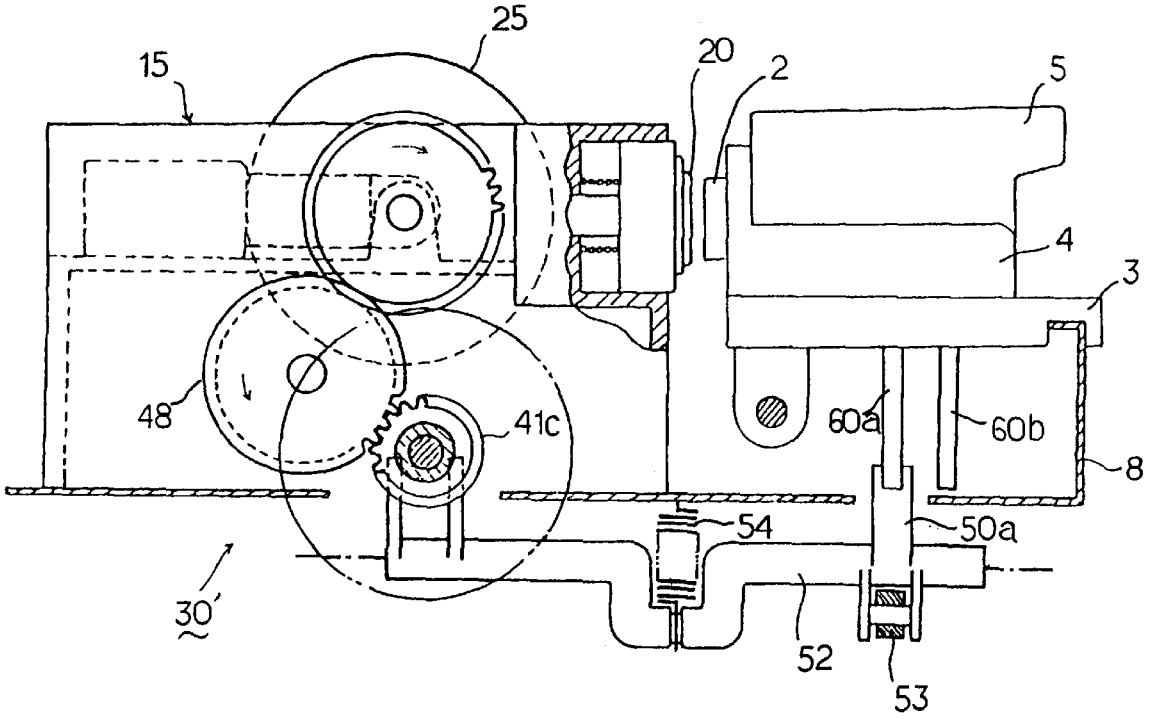
FIG. 22 is a side view showing the components of FIG. 21, the carriage and the purge mechanism.

A change-over mechanism according a second embodiment of the present invention will be described with reference to FIGS. 21 through 25. The change-over mechanism 30' includes first and second ribs 60*a* and 60*b* provided at the bottom of the carriage 3. These ribs 60*a,* 60*b* serve as abutting pieces and are adapted for abutting and kicking down first and second reclinable portions 50*a,* 50*b,* respectively. More specifically, the first and second ribs 60*a* and 60*b* are spaced away from each other in a direction perpendicular to the running direction of the carriage 3 as shown in FIGS. 21 and 22, and further, the first rib 60*a* is positioned toward the printing region and the second rib 60*b* is positioned toward the capping region. Furthermore, the first reclinable portion 50*a* and the second reclinable portion 50*b* are spaced away from each other similar to the first embodiment and are also spaced away from each other in a direction perpendicular to the running direction of the carriage 32, so that the first rib 60*a* can kick the first reclinable portion 50*a* and the second rib 60*b* can kick the second reclinable portion 50*b.* Remaining structure such as gear arrangement is the same as that of the first embodiment.

With this structure, if the carriage 3 is moved toward the capping position and enters the capping region, as shown in FIG. 23(*a*), the first rib 60*a* is brought into abutment with an upstanding first reclinable portion 50*a* as shown in FIG. 23(*b*). Before the first rib 60*a* contacts the first reclinable portion 50*a,* the second rib 60*b* has already entered into the capping region. However, because the second rib 60*b* is not in alignment with the first reclinable portion 50*a* in the running direction of the carriage 3, the second rib 60*b* cannot kick down the first reclinable portion 50*a.*

Figures 24A, 24B, 24C, 24D, 25A, 25B, 25C, 25D:
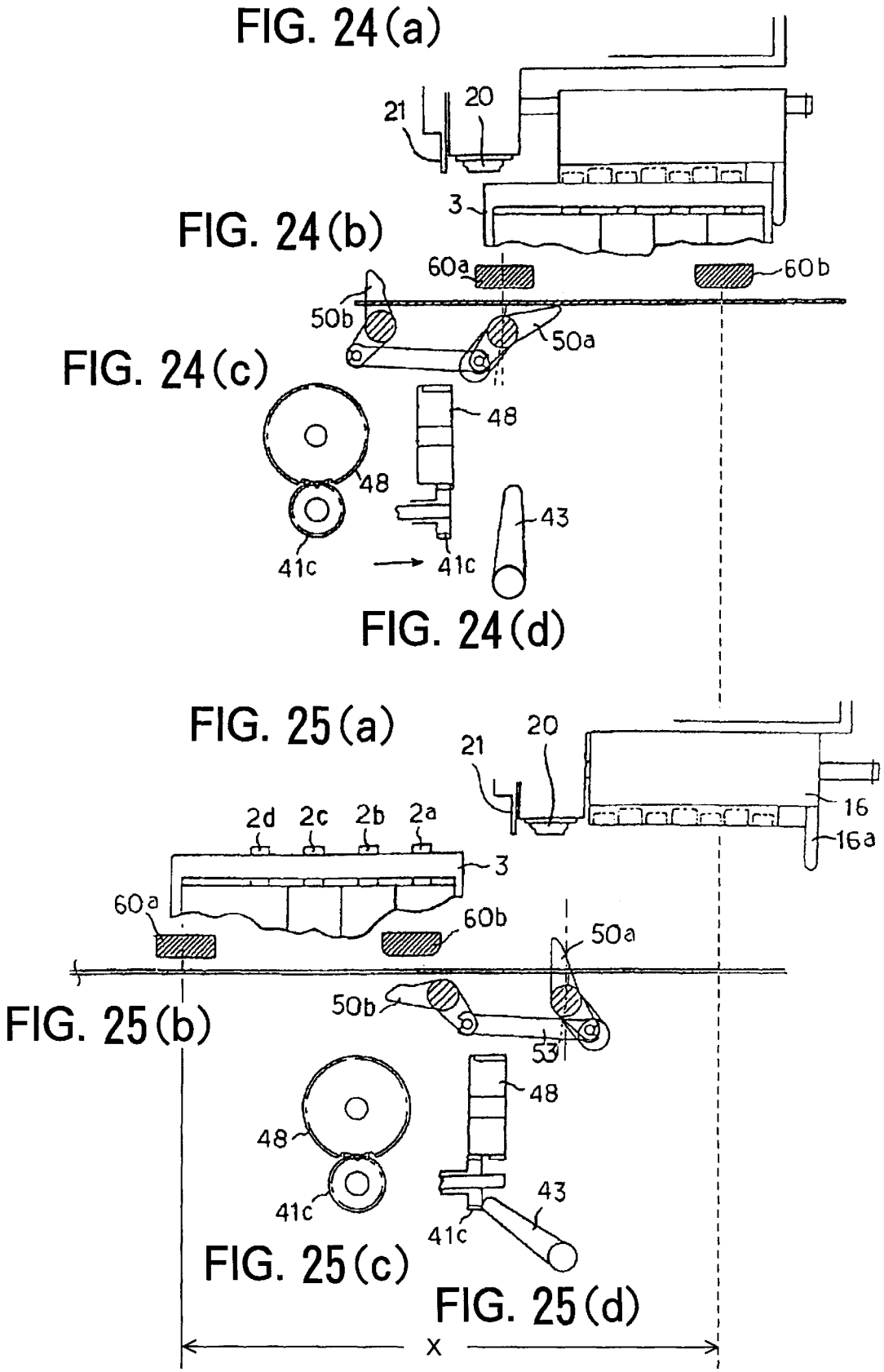
FIG. 24(*a*) is a view showing the positional relation between the purge mechanism and the carriage when the carriage reaches the capping position according to the second embodiment.
FIG. 25(*a*) is a view showing the positional relation between the purge mechanism and the carriage when the carriage moved toward the printing region according to the second embodiment.

When the carriage 3 reaches the capping position as shown in FIG. 24(*a*), the first rib 60*a* kicks down the first reclinable portion as shown in FIG. 24(*b*). As a result, the idle kicker 43 is pivotally moved in a clockwise direction in FIG. 23(*d*), so that the idle kicker 43 is moved away from the power distribution gear 41. Therefore, the power distribution gear 41 can be slidingly moved rightwardly in FIG. 24(*d*) to be brought into meshing engagement with the purge gear 48. Further, in synchronization with the kick-down movement of the first reclinable portion 50*a,* the second reclinable portion 50*b* is pivotally moved to its upstanding position as shown in FIG. 24(*a*).

If the carriage 3 is moved toward the printing region after completion of the maintenance to the nozzle as shown in FIG. 25(*a*), the second rib 60*b* kicks down the second reclinable portion 50*b* to rise up the first reclinable portion 50*a* as shown in FIG. 25(*b*). By the rising movement of the first reclinable portion 50*a,* the idle kicker 43 is pivotally moved to press the third gear 41*c,* so that the third gear 41*c* is disengaged from the purge gear 48 as shown in FIG. 25(*d*). During the movement of the carriage 3 toward the printing region, the first rib 60*a* moves past the second reclinable portion 50*b* before the second rib 60*b* contacts the second reclinable portion 50*b.* However, since the first rib 60*a* is positioned offset from the second reclinable portion 50*b* in the running direction as shown in FIG. 21, the first rib 60*a* cannot kick down the second reclinable portion 50*b.*

In the change-over mechanism 30' according to the second embodiment, a moving stroke X of the carriage 3 from the kicking position of the first rib 60*a* against the first reclinable portion 50*a* to the kicking position of the second rib 60*b* against the second reclinable portion 50*b* can be made longer than an actual distance between the positions of the first and second reclinable portions 50*a* and 50*b.* Therefore, Even if the distance between the first and second reclinable portions 50*a* and 50*b* is small, sufficient moving stroke of the carriage 3 can be provided for performing the maintenance operation. Consequently, entire size of the change-over mechanism 30' including the kick portions 50*a* and 50*b* can be reduced, and as a result, downsizing can be made in the entire printer.

A change-over mechanism according to a third embodiment of the present invention will be described with reference to FIGS. 26(*a*) through 26(*c*). In the third embodiment, a power distribution gear 141 includes a first gear 141*a* always engageable with the motor gear 46, a second gear 141*b* always engageable with the platen gear 12, a third gear 141*c* selectively engageable with a purge gear 148 and a disc portion 141*d* positioned beside the third gear 141*c*. A small diameter portion 141*e* is provided between the third gear 141*c* and the disc portion 141*d.* These are all arranged integrally and coaxially with one another.

A purge gear 148 includes a gear wheel 148*c* selectively engageable with the third gear 141*c,* and a flange portion 148*d* provided integrally and coaxially with the gear wheel 148*c.* The flange portion 148*d* is formed with an arcuate notch 148*e.* A radius of curvature of the arcuate notch 148*e* is substantially equal to a radius of curvature of the disc portion 141*d.*

Figure 26A:
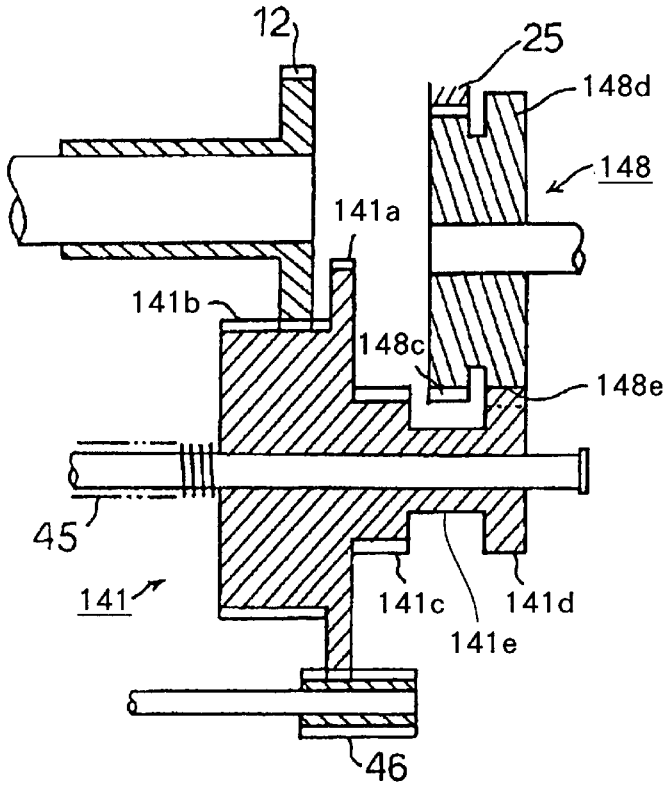
FIG. 26(*a*) is a cross-sectional view showing disengaging state of a power distribution gear from a purge gear according to a third embodiment of the present invention.
Figure 26C:
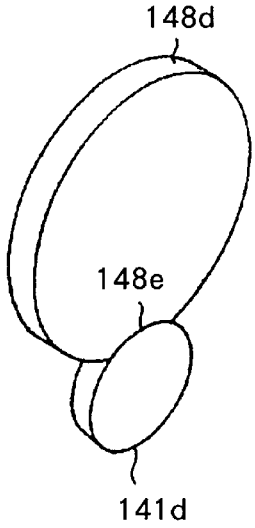
Figure 26B:
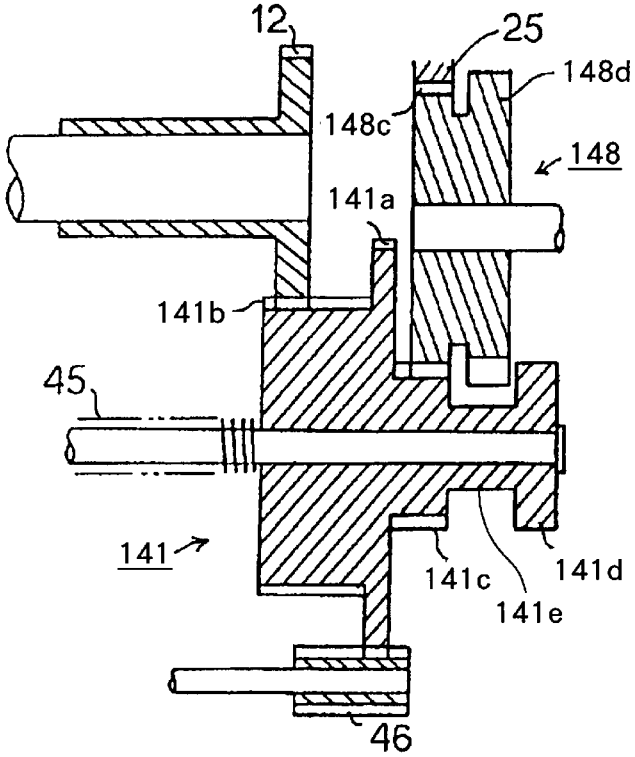

With this arrangement, if the third gear 141*c* of the power distribution gear 141 is disengaged from the gear wheel 148*c* of the purge gear 148, the gear wheel 148*c* confronts the small diameter portion 141*e,* and the disc portion 141*d* is fitted with the notched portion 148*e* of the flange portion 148*d* as shown in FIGS. 26(*a*) and 26(*c*). On the other hand, if the power distribution gear 141 is slidingly moved toward the purge gear 148 so that the third gear 141*c* is brought into meshing engagement with the gear wheel 148*c,* the disc portion 141*d* is separated from the notched portion 148*e,* and is brought into confrontation with the small diameter portion 141*e* as shown in FIG. 26(*b*). If the motor gear 46 is rotated, the power distribution gear 141 and the purge gear 148 are rotated. The flange portion 148*d* is also rotated together with the rotation of the gear wheel 148*c.*

During the rotation of the gear wheel 148*c* and the flange portion 148*d,* the notched portion 148*e* is positioned offset from the disc portion 141*d.* Therefore, even if the power distribution gear 141 is subjected to leftward urging force by the idle kicker 43 in FIG. 26(*b*) during rotation of the purge gear 148, the power distribution gear 141 cannot be slidingly moved because the disc portion 141*d* is not fitted with the notched portion 148*e.* When the purge gear 148 and the flange portion 148*d* are rotated by 360 degrees so that the notched portion 148*e* is brought into alignment with the disc portion 141*d,* the power distribution gear 141 can be moved leftwardly to obtain the state shown in FIG. 26(*a*). Until this alignment, maintenance period to the print head 2*a* through 2*d* can be prolonged. Further, after the power distribution gear is disengaged from the purge gear 48, the disc portion 141*d* can be stayed on the notched portion 148*e*. Therefore, the purge gear 148 cannot be rotated in normal nor reverse direction.

A change-over mechanism according to a fourth embodiment of the present invention will be described with reference to FIGS. 27(*a*) through 27(*c*). A power distribution gear 241 includes a first gear 241*a* always engageable with the motor gear 46, a second gear 241*b* always engageable with the platen gear 12, a third gear 241*c* selectively engageable with a purge gear 248, a disc portion 241*e*, and a small diameter portion 241*f*. The small diameter portion 244*f* is positioned beside the first gear 241*a*, and the disc portion 241*e* is positioned between the small diameter portion 241*f* and the third gear 241*c*. A diameter of the disc portion 241*e* is greater than that of the third gear 241*c*. These are all arranged integrally and coaxially with one another.

A purge gear 248 includes a gear wheel 248*f* selectively engageable with the third gear 241*c*, a flange portion 248*g* and a small diameter portion 248*i* positioned between the gear wheel 248*f* and the flange portion 248*g*. These are provided integrally and coaxially with one another. The flange portion 248*g* is formed with an arcuate notch 248*h*. A radius of curvature of the arcuate notch 248*h* is substantially equal to a radius of curvature of the disc portion 241*e*.

Figure 27A:
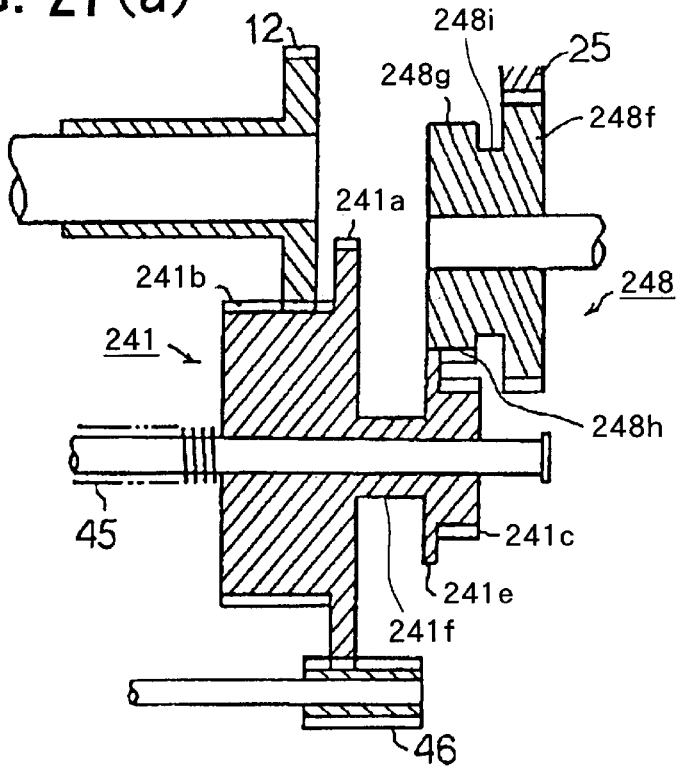
FIG. 27(*a*) is a cross-sectional view showing disengaging state of a power distribution gear from a purge gear according to a fourth embodiment of the present invention.
Figure 27C:
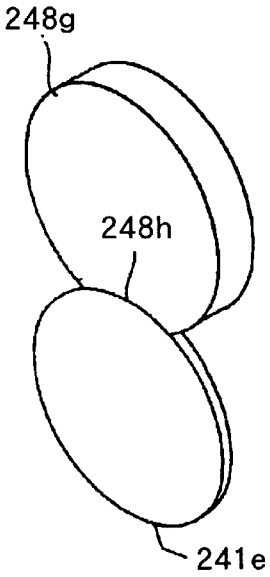
Figure 27B:
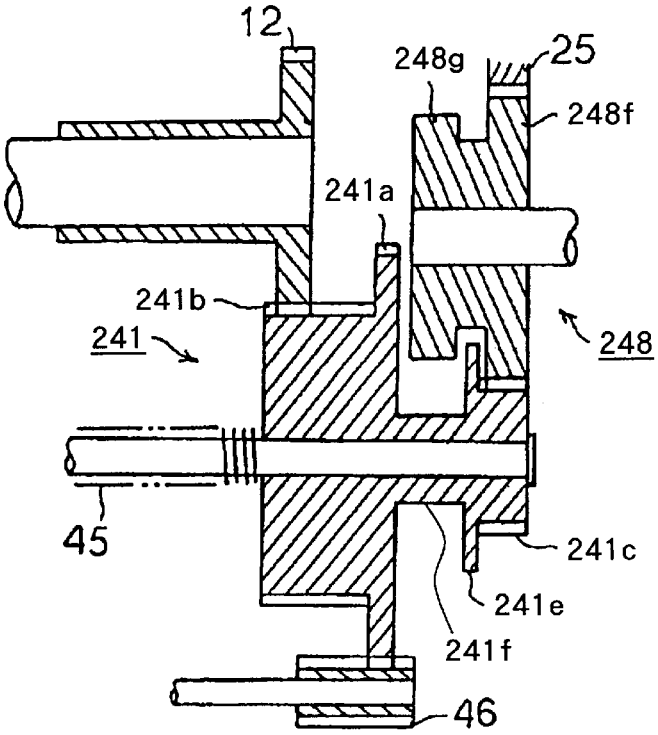

With this arrangement, if the third gear 241*c* of the power distribution gear 241 is disengaged from the gear wheel 248*f* of the purge gear 248, the disc portion 241*e* is fitted with the notched portion 248*h* of the flange portion 248*g* as shown in FIGS. 27(*a*) and 27(*c*). On the other hand, if the power distribution gear 241 is slidingly moved toward the purge gear 248 so that the third gear 241*c* is brought into meshing engagement with the gear wheel 248*f*, the disc portion 241*e* is separated from the notched portion 248*h*, and is brought into confrontation with the small diameter portion 248*i*, and the small diameter portion 241*f* is brought into confrontation with the flange portion 248*g* as shown in FIG. 27(*b*). If the motor gear 46 is rotated, the power distribution gear 241 and the purge gear 248 are rotated. The flange portion 248*g* is also rotated together with the rotation of the gear wheel 248*f*.

During the rotation of the gear wheel 248*f* and the flange portion 248*g*, the notched portion 248*h* is positioned offset from the disc portion 241*e*. Therefore, even if the power distribution gear 241 is subjected to leftward urging force by the idle kicker 43 in FIG. 27(*b*) during rotation of the purge gear 248, the power distribution gear 241 cannot be slidingly moved because the disc portion 241*e* is not fitted with the notched portion 248*h* but abuts the flange portion 248*g*. When the purge gear 248 and the flange portion 248*g* are rotated by 360 degrees so that the notched portion 248*h* is brought into alignment with the disc portion 241*e*, the power distribution gear 241 can be moved leftwardly to obtain the state shown in FIG. 27(*a*). Accordingly, similar to the foregoing embodiments, until this alignment, maintenance period to the print head 2*a* through 2*d* can be prolonged.

While the invention has been described in detail and with reference to the specific embodiment thereof, it would be apparent to those skilled in the art that various changes and modifications may be made therein without departing from the spirit and scope of the invention.

For example, in the depicted embodiment, the power distribution gear 41 is slidingly moved toward the purge gear 48 by the biasing force of the compression spring 45. However, the purge gear can be moved toward the power distribution gear. Further, in the illustrated embodiment, the platen gear 12 provided coaxially with the platen roller 11 is always engaged with the second gear 41*b* of the power distribution gear 31. However, the platen gear 12 can be disengaged from the second gear 41*b* when the third gear 41*c* is engaged with the purge gear 48.

Furthermore, in the above described embodiment, the maintenance or recovery operation can be performed with respect to all nozzles of the print heads 2*a* through 2*d*. However, at least one nozzle among the print head 2*a* through 2*d* can be subjected to the maintenance.

Furthermore, in the illustrated embodiment, a specific nozzle of the print head is sequentially subjected to suction by the suction cap 20, wiping by the wiper 21 and flashing. Upon completion of the sequential recovery operation with respect to the specific nozzle, then the remaining one of the nozzles of the print heads is subjected to the sequential recovery operation. However, it is possible to perform suction to each nozzle of the print heads, and then perform wiping to each nozzle, and then perform flashing to each nozzle. In the latter case, it is unnecessary to move back the carriage toward the capping position for sucking operation to the print head 2*b* after the flashing to the print head 2*a*. Rather, after suction operation to the print head 2*a*, the carriage can be slightly moved so that the print head 2*b* can be brought into confrontation with the suction cap 20. Accordingly, moving length of the carriage can be reduced, so that the entire nozzle recovery operation can be completed within a reduced period.

What is claimed is:

1. A printer for printing an image on a printing paper in a printing region comprising:

a sheet feeder for feeding the printing paper in a sheet feeding direction, said sheet feeder positioned at said printing region;

a printing portion including a carriage that moves in a line extending direction, and at least one print head at which a nozzle is formed for ejecting an ink, the print head being mounted on the carriage;

a purging mechanism including a negative pressure generating portion and a suction cap in communication therewith for covering the nozzle;

a drive source for driving the sheet feeder and the negative pressure generating portion; and a change-over mechanism for selectively transmitting a driving power of the drive source to the negative pressure generating portion; the change over mechanism comprising:

a power transmission member driven by the drive source that moves between a power shut off position and a power transmission position;

a power transmission change-over unit including a first reclinable portion that moves between an upstanding position and a reclining position for moving the power transmission member from the power shut off position to the power transmission position; a second reclinable portion that moves between an upstanding position and a reclining position for moving the power transmission member from the power transmission position to the power shut-off position, the second reclinable portion being positioned closer to the printing region than is the first reclinable portion, the first reclinable portion operatively connected to the second reclinable portion so that the first reclinable portion is moved in conjunction with movement of the second reclinable portion. one of the first reclinable portion and second reclinable portion being moved to said upstanding position thereof when a remaining one of the second reclinable portion and first reclinable portion is moved to said reclining position thereof;

an abutting piece attached to the carriage, the abutting piece being abutted against the first reclinable portion or second reclinable portion for reclining the first reclinable portion or second reclinable portion when the first reclinable portion or second reclinable portion is in said upstanding position; and moving means for moving the power transmission member from the power shut off position to the power transmission position in response to the reclining movement of the first reclinable portion, said moving means also moving the power transmission member from the power transmission position to the power shut off position in response to the reclining movement of the second reclinable portion.

2. The printer as claimed in claim 1, wherein the power transmission change-over unit further comprises: assisting means for assisting positioning of the power transmission member to said power transmission position and to said power shut off position after the first reclinable portion and the second reclinable portion are moved to said reclining position thereof.

3. The printer as claimed in claim 2, wherein the moving means is connected to the first reclinable portion, and wherein the assisting means comprises a tension spring connected to the first reclinable portion, the tension spring being pivotally moved between two spring positions and having a dead point line between the two spring positions.

4. The printer as claimed in claim 3, wherein the power transmission member comprises a plurality of gears arranged coaxially with each other, the plurality of gears being moved in an axial direction thereof.

5. The printer as claimed in claim 4, further comprising a negative pressure gear for driving the negative pressure generating portion, one of the plurality of gears of the power transmission member being selectively engaged with the negative pressure gear when the plurality of gears are moved to the power transmission position and being disengaged from the one of the plurality of gears when the plurality of gears are moved to the power shut-off position.

6. The printer as claimed in claim 5, further comprising allowing means for allowing movement of the plurality of gears to the power shut-off position only at a given rotational position of the allowing means.

7. The printer as claimed in claim 6, wherein the allowing means comprises:

a flange portion provided integrally with a side of the negative pressure gear, the side being closer to the power shut off position than is another side of the negative pressure gear; and a notched portion provided at the flange portion and gear teeth of the negative pressure gear.

8. The printer as claimed in claim 7, wherein the one of the plurality of gears is moved on the notched portion in the power-shut off position at the given rotational position of the negative pressure gear.

9. The printer as claimed in claim 6, wherein the allowing means comprises:

a flange portion provided integrally with a side of the negative pressure gear;

a notched portion provided at the flange portion; and a disc portion provided coaxially with the plurality of gears of the power transmission member, the disc portion being rested on the notched portion in the power shut off position at the give rotational position of the negative pressure gear.

10. The printer as claimed in claim 4, wherein the moving means comprises:

a kick member provided to the power transmission change-over unit for moving the plurality of gears toward the power-shut off position; and a compression spring connected to the plurality of gears for urging the plurality of gears toward the power transmission position.

11. The printer as claimed in claim 10, wherein the abutting position between the abutting piece and the first reclinable portion is provided at a position outside of the printing region.

12. The printer as claimed in claim 11, wherein the purge mechanism further comprises a protection cap disposed outside of the suction cap and outside of the printing region for capping a cap over the nozzle of the print head.

13. The printer as claimed in claim 12, wherein the abutting position between the abutting piece and the first reclinable portion is provided when the carriage reaches the protection cap.

14. The printer as claimed in claim 13, wherein the abutting position between the abutting piece and the second reclinable portion is positioned in or toward the printing region with respect to the suction cap.

15. The printer as claimed in claim 11, wherein the abutting piece comprises:

a first abutting piece disposed in alignment with the first reclinable portion in the line extending direction; and a second abutting piece disposed in alignment with the second reclinable portion in the line extending direction, the second abutting piece being spaced away from the first abutting piece in the sheet feeding direction, and the first abutting piece being closer to the printing region than is the second abutting piece.

16. The printer as claimed in claim 2, wherein the print head comprises a plurality of print heads for ejecting inks of different colors, the plurality of print heads being arrayed in the line extending direction.

17. A printer for printing an image on a printing paper in a printing region comprising:

a sheet feeder mechanism for feeding the printing paper in a sheet feeding direction, said sheet feeder mechanism positioned at said printing region;

a printing portion including a carriage that moves in a line extending direction, and at least one print head at which a nozzle is formed for ejecting an ink, the print head being mounted on the carriage;

a purging mechanism including a negative pressure generating portion and a suction cap in communication therewith for covering the nozzle;

a drive source for driving the sheet feeder and the negative pressure generating portion; and a change-over mechanism for selectively transmitting a driving power of the drive source to the negative pressure generating portion; the change over mechanism comprising:

a power transmission gear driven by the drive source that moves in an axial direction thereof between a power shut off position and a power transmission position;

a negative pressure gear for transmitting the driving power from the power transmission gear to the negative pressure generating portion, the negative pressure gear being engaged with the power transmission gear in the power transmission position and the negative pressure gear being disengaged from the power transmission gear in the power shut-off position;

means for pressing the power transmission gear comprising: a shaft portion, a kicker portion that pivotally moves about an axis of the shaft portion for moving the power transmission gear in the axial direction of the power transmission gear; a first reclinable portion that moves between an upstanding position and a reclining position for moving the power transmission gear from the power shut off position to the power transmission position, the first reclinable portion being pivoted about the axis of the shaft portion; a second reclinable portion that moves between an upstanding position and a reclining position for moving the power transmission gear from the power transmission position to the power shut-off position, the second reclinable portion being positioned in the printing region, the first reclinable portion operatively connected to the second reclinable portion so that the first reclinable portion is moved in conjunction with movement of the second reclinable portion, one of the first reclinable portion and second reclinable portion moved to said upstanding position thereof when a remaining one of the second reclinable portion and first reclinable portion is moved to said reclining position thereof; and an abutting piece attached to the carriage, the abutting piece being abutted against the first reclinable portion or second reclinable portion for reclining the first reclinable portion or second reclinable portion when the first reclinable portion or second reclinable portion is in said upstanding position.

18. The printer as claimed in claim 17, wherein the pressing means further comprises: means for assisting positioning of the power transmission gear to said power transmission position and to said power shut off position after the first reclinable portion and the second reclinable portion are moved to said reclining position thereof.

19. The printer as claimed in claim 18, wherein the assisting means comprises a tension spring connected to the first reclinable portion, the tension spring being pivotally moved between two spring positions and having a dead point line between the two spring positions.

20. The printer as claimed in claim 19, further comprising allowing means for allowing movement of the power transmission gear to the power shut-off position only at a given rotational position of the allowing means.

21. The printer as claimed in claim 20, wherein the allowing means comprises:

a flange portion provided integrally with a side of the negative pressure gear, the side being closer to the power shut off position than is another side of the negative pressure gear; and a notched portion provided at the flange portion and a part of gear teeth of the negative pressure gear.

22. The printer as claimed in claim 21, wherein the power transmission gear is moved on the notched portion in the power-shut off position at the given rotational position of the negative pressure gear.

23. The printer as claimed in claim 20, wherein the allowing means comprises:

a flange portion provided integrally with a side of the negative pressure gear;

a notched portion provided at the flange portion; and a disc portion provided coaxially with the power transmission gear, the disc portion being rested on the notched portion in the power shut off position at the give rotational position of the negative pressure gear.

24. The printer as claimed in claim 19, wherein the change over mechanism further comprises a compression spring connected to the power transmission gear for urging the power transmission gear toward the power transmission position, a biasing force of the tension spring being greater than that of the compression spring.

25. The printer as claimed in claim 24, wherein the abutting position between the abutting piece and the first reclinable portion is provided at a position outside of the printing region.

26. The printer as claimed in claim 25, wherein the purge mechanism further comprises a protection cap disposed outside of the suction cap and outside of the printing region for capping a cap over the nozzle of the print head.

27. The printer as claimed in claim 26, wherein the abutting position between the abutting piece and the first reclinable portion is provided when the carriage reaches the protection cap.

28. The printer as claimed in claim 27, wherein the abutting position between the abutting piece and the second reclinable portion is positioned in or toward the printing region with respect to the suction cap.

29. The printer as claimed in claim 17, wherein the abutting piece comprises:

a first abutting piece disposed in alignment with the first reclinable portion in the line extending direction; and a second abutting piece disposed in alignment with the second reclinable portion in the line extending direction, the second abutting piece being spaced away from the first abutting piece in the sheet feeding direction, and the first abutting piece being closer to the printing region than is the second abutting piece.

30. The printer as claimed in claim 17, wherein the print head comprises a plurality of print heads for ejecting inks of different colors, the plurality of print heads being arrayed in the line extending direction.

31. A printer for printing an image on a printing paper in a printing region comprising:

a sheet feeder for feeding the printing paper in a sheet feeding direction;

a printing portion including a carriage that moves in a line extending direction, and at least one print head at which a nozzle is formed for ejecting an ink, the print head being mounted on the carriage;

a purging mechanism including a negative pressure generating portion and a suction cap in communication therewith for covering the nozzle;

a drive source for driving the sheet feeder and the negative pressure generating portion; and a change-over mechanism for selectively transmitting a driving power of the drive source to the negative pressure generating portion; the change over mechanism comprising:

a power transmission gear driven by the drive source;

a negative pressure gear engaged with the power transmission gear to provide a power transmitting state for transmitting driving power from the power transmission gear to the negative pressure generating portion, and disengaged from the power transmission gear to provide a power shut off state;

a power transmission change-over unit comprising: a first reclinable portion that moves between an upstanding position and a reclining position for providing engagement between the power transmission gear and the negative pressure gear; a second reclinable portion that moves between an upstanding position and a reclining position for providing relative disengagement of the power transmission gear from the negative pressure gear, the second reclinable portion being positioned closer to the printing region than is the first reclinable portion, the first reclinable portion operatively connected to the second reclinable portion so that the first reclinable portion is moved in conjunction with movement of the second reclinable portion, one of the first reclinable portion and second reclinable portion being moved to said upstanding position thereof when a remaining one of the second reclinable portion and first reclinable portion is moved to said reclining position thereof; and, means for assisting positioning of the first reclinable portion and second reclinable portion;

means for permitting relative disengagement of the power transmission gear from the negative pressure gear when the negative pressure gear is rotated at a predetermined rotating position;

an abutting piece attached to the carriage, the abutting piece being abutted against the first reclinable portion or second reclinable portion for reclining the first reclinable portion or second reclinable portion when the first reclinable portion or second reclinable portion is in said upstanding position;

one of the power transmission gear and the negative pressure gear being slidingly moved in one direction to engage the remaining one of the negative pressure gear and the power transmission gear when the abutting piece kicks down the first reclinable portion in accordance with the movement of the carriage toward a direction outside the printing region, one of the power transmission gear and the negative pressure gear being slidingly moved in opposite direction to disengage from the remaining one of the negative pressure gear and the power transmission gear when the abutting piece kicks down the second reclinable portion in accordance with the movement of the carriage toward the printing region as far as the negative pressure gear has the predetermined rotating position, and one of the power transmission gear and the negative pressure gear being slidingly moved in the opposite direction while engagement between the power transmission gear and the negative pressure gear is maintained if the negative pressure gear is at a rotational position other than the predetermined rotating position.

* * * * *